US005598069A

United States Patent [19]

van Os et al.

[11] Patent Number: 5,598,069

[45] Date of Patent: Jan. 28, 1997

[54] AMALGAM SYSTEM FOR ELECTRODELESS DISCHARGE LAMP

[75] Inventors: Ron van Os, Sunnyvale; David Chazen, Palo Alto, both of Calif.

[73] Assignee: Diablo Research Corporation, Sunnyvale, Calif.

[21] Appl. No.: 559,255

[22] Filed: Nov. 15, 1995

Related U.S. Application Data

[63] Continuation of Ser. No. 352,267, Dec. 7, 1994, abandoned, which is a continuation of Ser. No. 129,893, Sep. 30, 1993, abandoned.

[51] Int. Cl.[6] ..... H05B 41/16

[52] U.S. Cl. ..... 315/248; 313/490

[58] Field of Search ..... 315/248, 34, 39, 315/46; 313/490

[56] References Cited

U.S. PATENT DOCUMENTS

| | | | |
|---|---|---|---|
| 3,526,803 | 9/1970 | Wainio | 313/109 |
| 3,534,212 | 10/1970 | Evans | 313/174 |
| 4,093,889 | 6/1978 | Bloem et al. | 313/229 |
| 4,262,231 | 4/1981 | Anderson et al. | 313/490 |
| 4,383,203 | 5/1983 | Stanley | 315/248 |
| 4,437,041 | 3/1984 | Roberts | 315/248 |
| 4,622,495 | 11/1986 | Smeelen | 315/248 |
| 5,013,975 | 5/1991 | Uhegawa et al. | 313/248 |
| 5,148,085 | 9/1992 | Kroes | 315/248 |
| 5,216,322 | 6/1993 | Fuchs | 313/484 |
| 5,412,288 | 5/1995 | Borowiec et al. | 315/248 |
| 5,412,289 | 5/1995 | Thomas et al. | 315/248 |
| 5,500,567 | 3/1996 | Wilson et al. | 315/248 |

OTHER PUBLICATIONS

A. Netten et al., "The operating principles of the Philip QL lamp system," Philips Lighting B. V. 1991, pp. 2–15.

*Primary Examiner*—Robert Pascal
*Assistant Examiner*—Darius Gambino
*Attorney, Agent, or Firm*—Skjerven, Morrill, MacPherson, Franklin & Friel; Arthur J. Behiel; David E. Steuber

[57] ABSTRACT

An amalgam system for optimizing the mercury vapor pressure of an electrodeless discharge fluorescent lamp is disclosed. A coil network induces an electric discharge in a gas mixture contained in a sealed lamp vessel. An amalgam is supported in the discharge and thermally isolated from the lamp vessel by a thin glass strand. The discharge transfers power directly to the amalgam, thus quickly heating the amalgam. Rapid heating of the amalgam provides a rapid increase in mercury vapor pressure in the lamp so that the light output rises quickly when the lamp is energized. An impedance matching and filter network is constructed such that, in combination with the coil/plasma load, it provides a desired steady-state impedance and a desired start-up impedance.

36 Claims, 14 Drawing Sheets

AMALGAM SYSTEM FOR ELECTRODELESS DISCHARGE LAMP

This application is a continuation of application Ser. No. 08/352,267, filed Dec. 07, 1994, now abandoned, which is a continuation of application Ser. No. 08/129,893, filed Sep. 30, 1993, now abandoned.

CROSS-REFERENCE TO RELATED APPLICATIONS

This application relates to, and incorporates by reference, commonly-owned application Ser. No. 07/887,166, filed May 20, 1992, now abandoned, and commonly-owned U.S. Pat. No. 5,5,41,492 issued Jul. 30, 1996 both of which are entitled "Impedance Matching and Filter Network For Use With Electrodeless Discharge Lamp."

BACKGROUND

This invention relates to electric discharge devices and particularly to improved electrodeless discharge fluorescent lamps comprising mercury vapor and radio-frequency (RF) power supplies, wherein the mercury vapor pressure is controlled by means of amalgam-forming metals. As is known, electrodeless discharge lamps have several significant advantages over conventional incandescent lamps, including a far greater efficiency in converting electrical energy into light energy. The commercial development of these lamps has been hindered, however, by several technical problems, one of which is their inability to produce a consistent light output over a wide range of ambient temperatures.

As is well known, the mercury vapor pressure within fluorescent lamps must be maintained within prescribed limits during operation to optimize light output. Typically, a range of pressure from about 4.5 mTorr to about 7.0 mTorr yields an acceptable light output. At higher pressures, ultraviolet (UV) photons produced by excited mercury atoms become self-imprisoned, and are thus prevented from reaching the vessel wall where they can activate the phosphor layer, which converts UV photon energy into visible light. At lower pressures, insufficient mercury is available to generate the UV radiation necessary to the operation of the lamp. Since the mercury vapor pressure is a function of temperature, proper regulation of the mercury vapor pressure is difficult to achieve, as the temperature of the lamp is subject to change due to internally generated heat and changes in ambient temperature.

A degree of control over mercury vapor pressure can be obtained by placing a predetermined amount of an amalgamating metal within the lamp at a location where it will combine with the mercury and form an amalgam that operates at a preselected temperature when the lamp is energized. Since the mercury vapor pressure surrounding such an amalgam is lower than the vapor pressure of pure mercury at the same temperature, the amalgam retains control of the mercury vapor pressure.

While the presence of the amalgam reduces the mercury vapor pressure in a hot lamp, it also unfortunately reduces the mercury vapor pressure when the lamp is cool. Thus, lamp efficiency is decreased until the amalgam is brought up to operating temperature.

In addition to the efficiency problems normally associated with fluorescent lamps, RF-excited electrodeless fluorescent lamps present special problems with respect to temperature control. First, since they are intended to replace incandescent lamps in a wide range of applications, they must operate over a broader range of ambient temperatures than is normally expected of fluorescent lamps. Second, before a plasma forms to create a reflected impedance, the RF power supply is unloaded. Therefore, these lamps must turn on quickly to avoid damage associated with extended overdriving of the power supply. Finally, RF-excited light sources tend to have higher energy densities in the plasma discharge and higher wall loadings than conventional tube-type fluorescent lamps, which are characteristics that make control of the amalgam operating temperature more difficult.

Prior electrodeless discharge lamps address these problems by placing some amalgam material at a location within the lamp where it can be heated quickly by the discharge formed in the lamp when the lamp is energized. Energy transferred from the plasma heats the start-up amalgam and quickly brings it to the desired temperature. Under steady-state conditions, the start-up amalgam in the plasma is too hot for optimum lamp efficiency, so mercury vapor pressure control automatically transfers to a control amalgam at a cooler location in the lamp. Such a system is described in U.S. Pat. No. 4,622,495, entitled "Electrodeless Discharge Lamp With Rapid Light Build-Up."

In such a two-amalgam system, the control amalgam is in thermal contact with a relatively cool spot on an inside surface of the lamp, and the amalgamating metal of the control amalgam is selected to obtain the proper mercury vapor pressure at a desired operating temperature. Because the control amalgam is in thermal contact with the bulb of the lamp, the temperature of the bulb essentially controls the mercury vapor pressure. Since the bulb temperature is dependent on ambient temperature, the mercury vapor pressure determined by the control amalgam is sensitive to changes in ambient temperature. This sensitivity to changes in ambient temperature decreases the range of ambient temperatures over which the lamp effectively operates.

Another problem of prior art lamps results from the use of a relatively low-temperature control amalgam. When the lamp is first switched-on, the start-up amalgam quickly releases its mercury. The much cooler control amalgam will attempt to control the mercury vapor to a lower pressure by collecting mercury from the lamp vessel. The control amalgam will continue to pull mercury from the lamp vessel, and thus reduce the mercury vapor pressure below the optimal level, until the control amalgam reaches the desired operating temperature.

As a result of the control amalgam's tendency to provide unacceptably low mercury vapor pressure during start-up, a low-temperature control amalgam must be selected so that the control amalgam attains its operating temperature quickly. Otherwise, the lamp will suffer significantly decreased light output during warm-up.

While the use of a low-temperature control amalgam gives a reasonable light output during warm-up, there are difficulties associated with keeping low-temperature amalgams cool. For example, since power electronics produce heat, the need for a low operating temperature increases the difficulties associated with integrating electronics into the lamp and limits the amount of power that may be supplied to the lamp. Moreover, prior art lamps rely on lamp surfaces to conduct heat from control amalgams to keep the amalgams cool. Because these lamp surfaces are sensitive to changes in ambient temperature, the control amalgam is also sensitive to changes in ambient temperature. This sensitivity to ambient temperature decreases the range of ambient temperatures over which prior art electrodeless discharge lamps operate efficiently and increases the difficulty of stabilizing the mercury vapor pressure. These constraints seriously limit the general usefulness of these lamps as replacements for conventional incandescent lamps.

For the foregoing reasons, there is a need for fast-starting electrodeless discharge lamps wherein the light output is optimal over a broad range of ambient temperatures.

SUMMARY

The present invention is directed to amalgam systems that provide electrodeless discharge lamps that start quickly and are essentially insensitive to changes in ambient temperature over a broad range of ambient temperatures.

In accordance with one embodiment of the present invention, a sealed lamp vessel contains a gas consisting of mercury vapor and a rare gas. A coil network, which may be disposed within a tubular indentation in the lamp vessel, is provided to induce a plasma in the gas mixture when power is applied to the coil network. A supporting member, preferably made of a thermally nonconductive material, supports a high-temperature control amalgam in the plasma. An impedance matching and filter network is interposed between a radio-frequency amplifier and the coil network.

The coil/plasma load has an inherent impedance that varies with the power input to the load and the mercury vapor pressure in the vessel. The impedance matching and filter network is constructed such that, in combination with the coil/plasma load, it provides a desired impedance at start-up and a desired steady-state impedance. The start-up impedance is selected to provide maximum power transfer to the plasma when the amalgam temperature is low, and therefore ensure a fast start-up. The steady-state impedance is selected to maximize the efficiency of power transfer to the load when the amalgam is operating at its steady-state temperature. For example, in one embodiment the impedance matching and filter network ensures that 19–24 watts of RF power are supplied during start-up and 15–20 watts of RF power are supplied during steady-state operation.

The amalgam is supported in the plasma by a thin strand, preferably made of glass, having very low thermal conductivity. Being thus isolated, the amalgam does not exchange an appreciable amount of thermal energy with lamp surfaces by conduction. Because the amalgam is in intimate contact with the plasma, power from the plasma directly heats the amalgam. Further, since the amalgam is thermally isolated from lamp surfaces, thermal energy may only leave the amalgam via thermal (infrared) radiation. Thus, the temperature of the amalgam is essentially determined by the power transferred to the amalgam from the plasma and the thermal power radiated from the amalgam.

According to the Stefan-Boltzmann law, the thermal power radiated from the amalgam is proportional to the fourth power of amalgam temperature. Consequently, because the amalgam temperature is low when the lamp is first energized, the thermal power radiated by the amalgam is also low when the lamp is first energized. As the lamp warms up, the power radiated by the amalgam will increase as the amalgam is heated by energy transferred to the amalgam by the plasma. The temperature of the amalgam will continue to rise until the temperature is such that the power radiated from the amalgam is equal to the power input to the amalgam from the plasma. This equilibrium temperature is the steady-state operating temperature of the amalgam for the particular plasma power.

When a lamp in accordance with this embodiment of the present invention operates in the steady state (i.e., when the amalgam is at its steady-state temperature), an increase in amalgam temperature will increase the mercury vapor pressure, which will in turn increase the impedance of the coil/plasma load. The impedance matching and filter network will respond to the increase in impedance by decreasing the power input to the plasma. Also, because of the increase in amalgam temperature, the power radiated by the amalgam will increase. Thus, a feedback system is created, which will respond to an increase in amalgam temperature by reducing the power transferred to the amalgam and increasing the power radiated away from the amalgam, thereby causing the amalgam to return to its steady-state temperature.

Conversely, a decrease in amalgam temperature from the steady-state temperature will decrease the mercury vapor pressure, which in turn decreases the impedance of the coil/plasma load. The impedance matching and filter network will respond to the decrease in impedance by increasing the power input to the plasma. In addition, because of the decrease in amalgam temperature, the power radiated by the amalgam will decrease. Accordingly, the feedback system will respond to a decrease in amalgam temperature from the amalgam's steady-state temperature by decreasing the power radiated from the amalgam and increasing the power transferred to the amalgam, thus causing the amalgam to heat to its steady-state temperature.

In another embodiment of the present invention, two amalgam samples are suspended in the plasma. One amalgam sample is the control amalgam, and consists of a high-temperature amalgamating metal. The control amalgam is used to control mercury vapor pressure in much the same way as described above regarding the previous embodiment.

The second amalgam sample is used only during start-up. This start-up amalgam has a lower operating temperature than the control amalgam, so that after the lamp is switched on essentially all of the mercury of the start-up amalgam is quickly released into the lamp vessel. In this way, the mercury vapor pressure inside the lamp vessel rises rapidly and a comparatively high light output is consequently obtained a short time after the lamp is switched on. Once the lamp reaches its operating temperature, the control amalgam controls the mercury vapor pressure as described in connection with the first embodiment of the invention.

In accordance with another embodiment of the present invention, the supporting member supports a start-up amalgam positioned in the plasma as well as a control amalgam thermally insulated both from the plasma and from the ambient environment.

The start-up amalgam is supported in the lamp vessel by a thin strand, preferably made of glass, having very low thermal conductivity. The position of the start-up amalgam is such that it is directly heated by the electric discharge produced by the coil network as soon as the lamp is switched on. Thus, the start-up amalgam is rapidly heated at start-up so that essentially all the mercury of the start-up amalgam is released into the lamp vessel.

The control amalgam is insulated from the ambient environment via the virtual vacuum in the lamp vessel and a heat dam between the control amalgam and the power supply electronics. Therefore, the control amalgam is primarily heated by plasma radiation and thermal losses from the coil network, both of which are relatively constant over a wide range of ambient temperatures. Thus, the control amalgam will have a stable operating temperature and will provide the desired mercury vapor pressure over a wide range of ambient temperatures.

Pure mercury provides optimal mercury vapor pressure at a lower temperature than do the aforementioned amalgams. Thus, the lamp is designed so that pure mercury, condensed on cool lamp surfaces, controls the mercury vapor pressure when the lamp is first energized. Since optimal vapor pressure is obtained from the high-temperature control amalgam at a relatively high temperature, control of the mercury pressure is turned over to the control amalgam as the lamp approaches its steady-state temperature.

At start-up, the start-up amalgam is quickly heated by the discharge produced by the coil network so that the mercury of the start-up amalgam is released into the lamp vessel. When the mercury of the start-up amalgam is released, the mercury vapor pressure in the lamp vessel becomes greater than both the mercury vapor pressure above the control amalgam and the mercury vapor pressure of pure mercury at the relatively cool lamp surface temperatures. Thus, mercury vapor will condense on cool lamp surfaces and begin to combine with the control amalgam.

When the lamp operates in the steady-state, the lamp surfaces will be devoid of mercury and the control amalgam will control mercury vapor pressure in the lamp vessel. However, because the control amalgam is positioned such that the time constant of diffusion to the control amalgam (i.e., the time required for mercury atoms to diffuse to the control amalgam) is relatively large, it takes much longer for mercury atoms to diffuse to the control amalgam than to nearby lamp surfaces. Moreover, the cool lamp surfaces are much more effective at collecting mercury vapor than the control amalgam because the lamp surfaces have much greater surface area than the control amalgam. Consequently, substantially all of the mercury released by the start-up amalgam initially condenses on cool lamp surfaces.

As the lamp heats up, the control amalgam will collect mercury from the gas phase as the control amalgam approaches its operating temperature. Moreover, mercury condensed on lamp surfaces will vaporize to replace the mercury collected from the gas phase by the control amalgam. Eventually, the lamp surfaces will be devoid of mercury, so that control of the mercury vapor pressure will be transferred from the lamp surfaces to the control amalgam.

To take advantage of the lower vapor pressure of pure mercury during warm-up and subsequently turn control of mercury vapor pressure over to the control amalgam when the control amalgam is warmed to an appropriate temperature, the time constant of diffusion to the control amalgam must be matched to the time constant associated with the warm-up of the control amalgam. Such matching is accomplished by selecting the diffusion length between the control amalgam and the start-up amalgam, the cross-sectional area of the diffusion path, and the surface of area of the control amalgam.

As a result of the aforementioned amalgam systems, electrodeless discharge lamps in accordance with the present invention will quickly reach maximum light output and will have steady-state control amalgam temperatures that are largely independent of ambient temperature over a broad range of ambient temperatures.

DESCRIPTION OF THE DRAWINGS

These and other features, aspects, and advantages of the present invention will become better understood with regard to the following description, appended claims, and accompanying drawings where:

DETAILED DESCRIPTION

Figure 1:
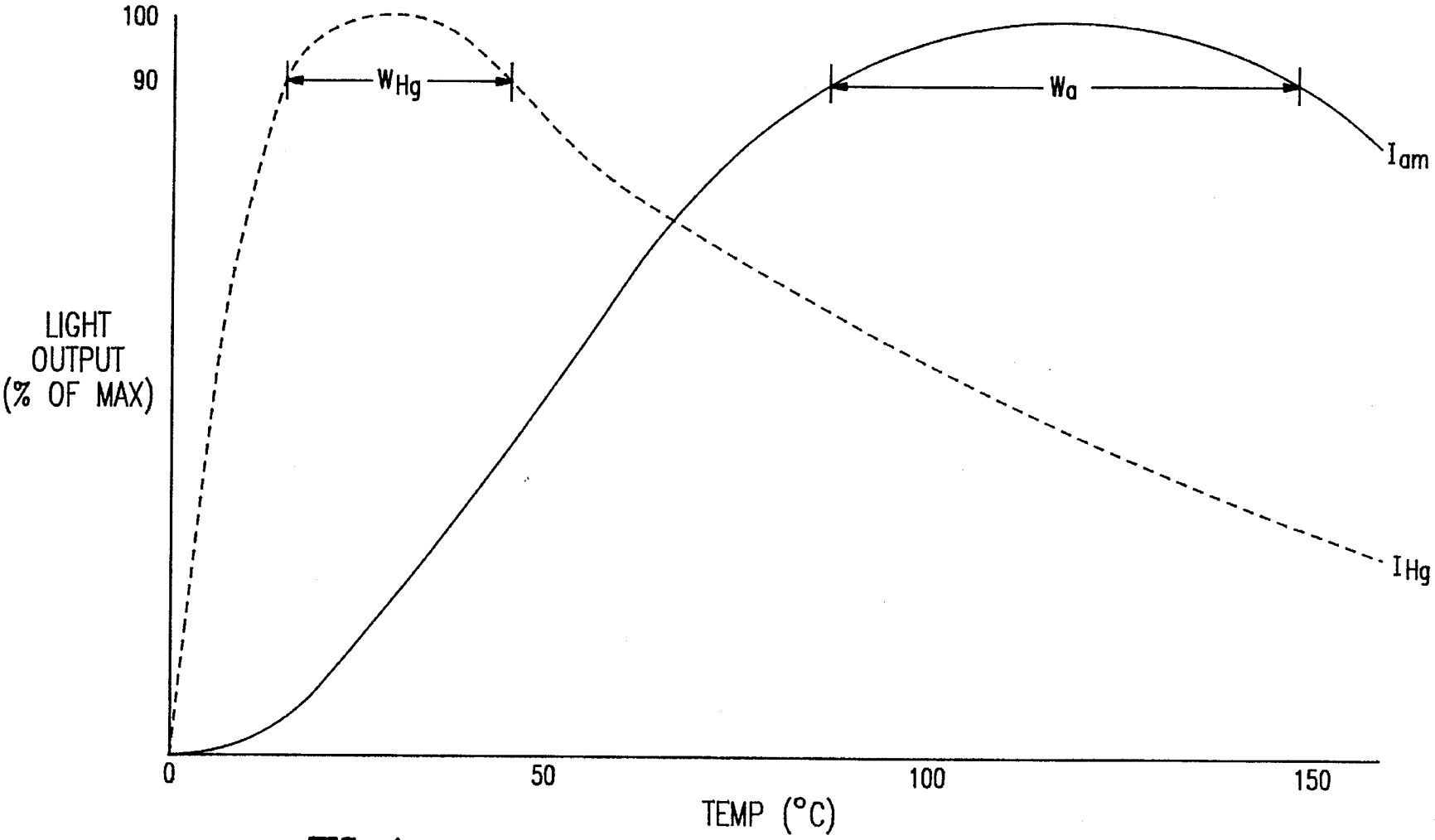
FIG. 1 shows the relationship between light output and temperature for (i) a lamp system using pure mercury and (ii) a lamp system using an amalgam.

FIG. 1 illustrates the principle upon which amalgams operate. FIG. 1 shows the relationship between light output and temperature for an electrodeless discharge lamp using pure mercury and for a similar lamp using an amalgam. Curve $I_{Hg}$ represents the intensity of light output by the lamp with respect to the temperature of pure mercury. This relationship exists because the mercury vapor pressure changes with respect to the temperature of the mercury, and the light output is a function of the mercury vapor pressure. It has been found that the peak light output occurs when the mercury vapor pressure is approximately 6 mTorr, which occurs at approximately 35 ° C. for pure mercury. The window $W_{Hg}$ represents the range of mercury temperatures over which light output efficiency is greater than or equal to 90% of maximum.

The curve $I_{am}$, in FIG. 1 represents the output intensity of light with respect to the temperature of an amalgam. As is well known in the art, the mercury vapor pressure may be changed by placing an amalgamating metal, such as indium, within a lamp where it will combine with mercury and form an amalgam. Since the mercury vapor pressure above such an amalgam is lower than that above pure mercury at the same temperature, the amalgam is able to retain control of the mercury vapor pressure over a wider temperature range than pure mercury. For example, the 60° C. window centered on approximately 130° C. (assuming an indium amalgam of 3% mercury) represents the range of indium amalgam temperatures over which light output efficiency is greater than or equal to 90% of maximum.

Figure 2:
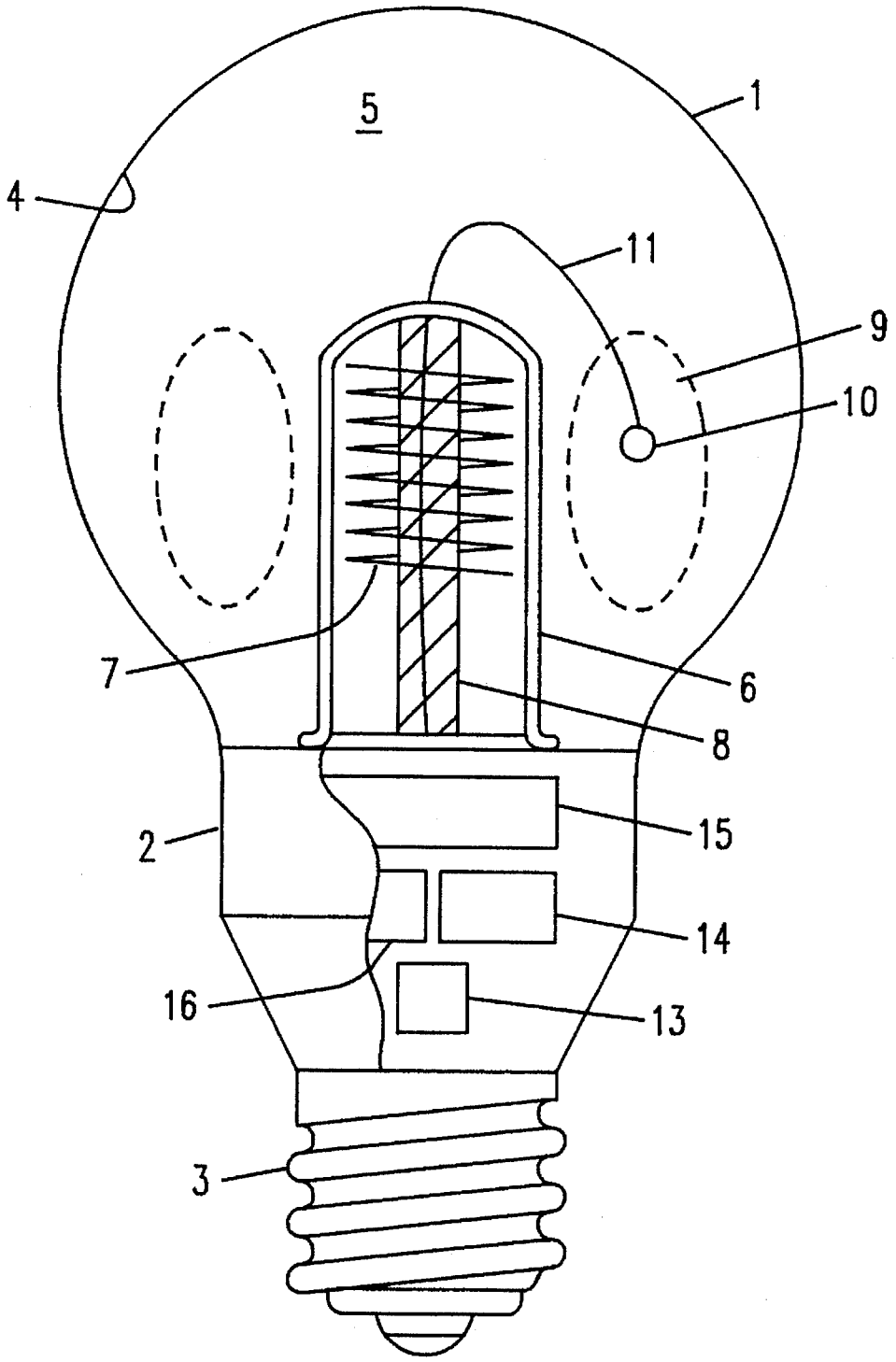
FIG. 2 shows a partial cross-sectional view of an electrodeless discharge lamp using a feedback system in accordance with a first embodiment of the invention.

FIG. 2 shows an electrodeless discharge lamp comprising a glass lamp vessel 1, a power supply housing 2, and a threaded base 3. Threaded base 3 is adaptable to a standard light socket.

Lamp vessel 1 is sealed from the environment and contains a gas mixture 5 consisting of mercury vapor and a rare gas. A phosphor coating 4 is disposed on the inner surface of lamp vessel 1 for converting ultraviolet radiation into visible light. Of course, a lamp may be made without a phosphor coating, as where an ultraviolet light source is desirable (e.g., for germicidal applications). A tubular indentation 6 extends into lamp vessel 1. Extending coaxially through tubular indentation 6 is a tipoff tube 8, which is sealed at its lower end during manufacture and open to the inside of lamp vessel 1. A coil network 7, disposed within tubular indentation 6 and surrounding tipoff tube 8, is provided to induce a plasma 9 in gas mixture 5 when power is applied to coil network 7. Extending through tipoff tube 8, and into lamp vessel 1, is a supporting member 11, preferably made of a thermally nonconductive material, for supporting a high-temperature amalgam 10.

In this embodiment, supporting member 11 is a strand of glass, approximately 0.5 mm in diameter. Other embodiments include strands comprising tungsten or molybdenum. Supporting member 11 supports amalgam 10 and thermally isolates amalgam 10 from lamp vessel 1.

Amalgam 10 is disposed on one end of supporting member 11 so that amalgam 10 is within plasma 9. Being thus positioned, amalgam 10 absorbs some energy from, and is therefore heated by, plasma 9.

A rapid warm-up of amalgam 10 is desirable because amalgam 10 provides optimal light output at or near its operating temperature. The warm-up time of amalgam 10 depends on the mass of the amalgam sample (a low mass requiring less energy to heat) and the amount of power incident the surface of amalgam 10. The power incident the surface of amalgam 10 in turn depends on the surface area of amalgam 10. Thus, in a preferred embodiment of the present invention, the surface area of a small amalgam sample, approximately 60 to 90 mg, is maximized to ensure a fast warm-up.

Because amalgam 10 absorbs energy directly from plasma 9 and is thermally isolated from lamp surfaces, amalgam 10 is heated above the operating temperatures normally associated with the controlling amalgams of fluorescent lamps. For example, in a preferred embodiment the operating temperature of amalgam 10 is approximately 220° C. A special high-temperature amalgam, consisting of an amalgamating metal of approximately 85% indium and 15% silver, combined with an amount of mercury having a mass of approximately 3 to 5% of the mass of the amalgamating metal, may be used to retain control of the mercury vapor pressure at this temperature. Such an amalgam provides an acceptable level of mercury vapor pressure at temperatures ranging from approximately 190° to 250° C. Where desired, higher amalgam operating temperatures may be obtained using an amalgamating metal having a higher silver content. For example, an amalgam comprised of an amalgamating metal of 30% silver and 70% indium provides an acceptable level of mercury vapor pressure at temperatures ranging from approximately 280° to 340° C.

Amalgam 10 is secured to supporting member 11 via pieces of gold-plated nickel mesh attached to supporting member 11 at the appropriate location. The gold-plated mesh is coated with the appropriate amount of amalgamating metal. Alternatively, the amalgamating metal may be applied directly to supporting member 11 by precleaning supporting member 11 with hydrofluoric acid and subsequently immersing supporting member 11 in an ultrasonic vibration bath containing the amalgamating metal.

Power supply housing 2 contains an oscillator 13 for providing an RF signal. RF amplifier 14 receives the RF signal from oscillator 13 and amplifies it to a usable level. An impedance matching and filter network 15 matches the output impedance of RF amplifier 14 to the reflected impedance of the load of plasma 9 and coil network 7, and filters unwanted harmonics from the amplified RF signal. A power supply 16 provides power to oscillator 13 and RF amplifier 14.

The RF signal supplied by oscillator 13 may be anywhere in the range of from 100 KHz to 30 MHz. This embodiment, however, makes use of the FCC approved ISM (industrial, scientific and medical) frequencies of 6.78 and 13.56 MHz. At these frequencies, the required inductance of coil network 15 is approximately 0.5 to 5 μH, which may be obtained with an air-wound coil. Thus, there is no need for a coil having a ferrite core. A ferrite core may be used in applications where lower oscillator frequencies are desirable (e.g., below 5 MHz), as described in U.S. Pat. No. 3,521,120 to Anderson.

To achieve appropriate inductance values at the ISM frequencies of 6.78 and 13.56 MHz, air-wound coils should have diameters of approximately 0.5 to 2 inches. A preferred embodiment of the present invention uses an air-wound coil approximately 1 inch in diameter.

Impedance matching and filter network 15 is interposed between RF amplifier 14 and coil network 7. The load consisting of coil network 7 and plasma 9 has a reflected impedance that varies with the density of mercury vapor in the gas mixture 5. The mercury vapor density depends upon the vapor pressure of the mercury, which is in turn dependent upon the temperature of amalgam 10.

Figure 3:
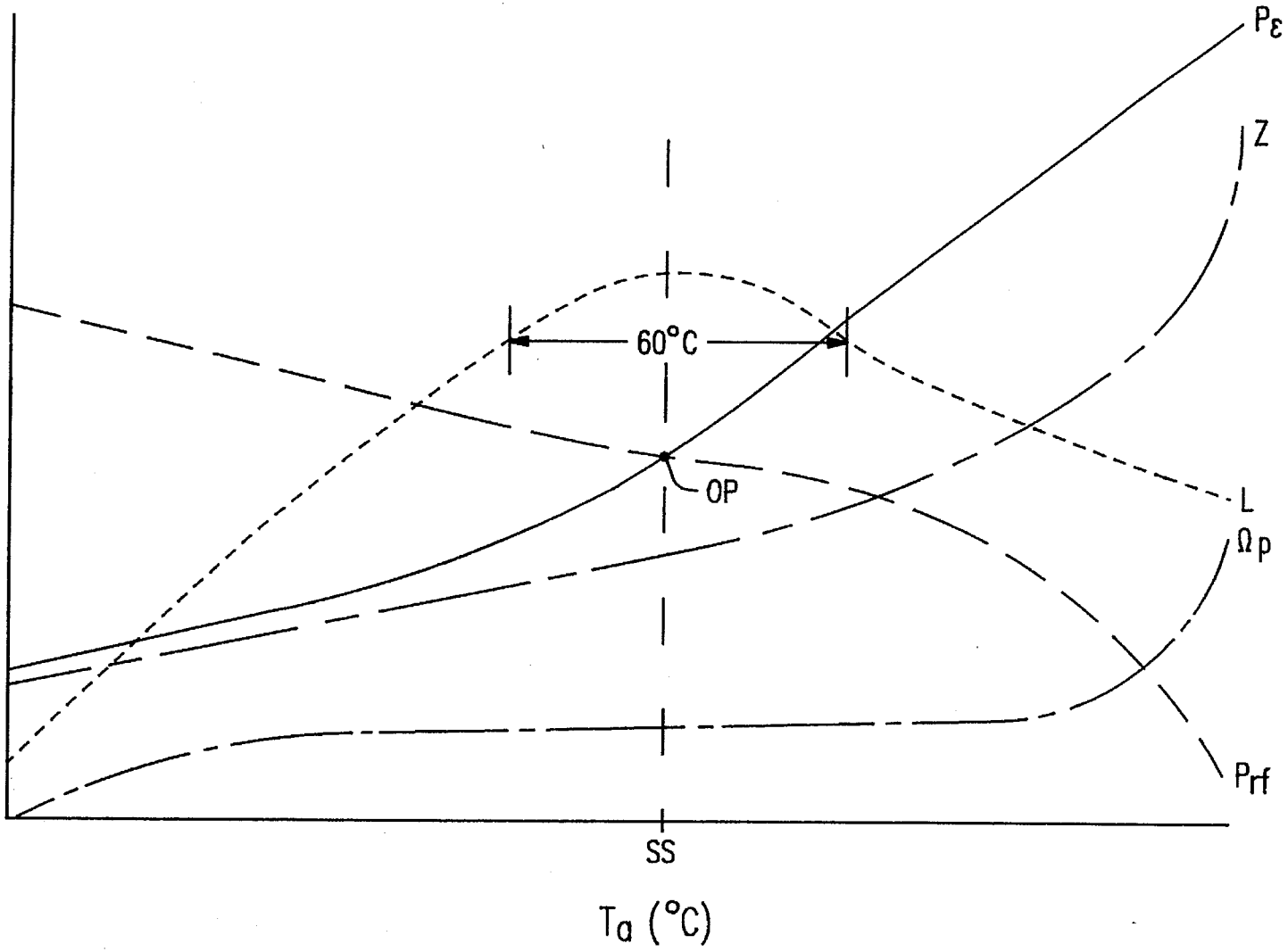
FIG. 3 shows the relationship between various parameters and the temperature of the amalgam in an electrodeless discharge lamp in accordance with the first embodiment of the invention.

FIG. 3 shows the relationship between various parameters of the lamp and the temperature of amalgam 10 ($T_a$). Curve L represents the intensity of light output by the lamp with respect to the temperature of amalgam 10. This relationship exists because mercury vapor pressure changes with respect to the temperature of amalgam 10, and light output is a function of mercury vapor pressure. Peak light output occurs when the mercury vapor pressure is 6 mTorr, so amalgam 10 is designed to provide 6 mTorr of mercury vapor pressure when operating at its steady-state temperature SS of approximately 220° C. The 60° C. window centered on steady-state temperature SS represents the range of amalgam temperatures over which light output efficiency is greater than or equal to 90% of maximum.

The curve labeled $\Omega_P$ represents the inherent impedance of the load consisting of coil network 7 and plasma 9. As the temperature of amalgam 10 increases, the mercury vapor pressure also increases, thus causing more mercury atoms to leave amalgam 10 and enter the gas phase. The increase in mercury vapor density results in a corresponding increase in the impedance of plasma 9. Thus, the curve $\Omega_P$ rises as the temperature of amalgam 10 increases.

The impedance matching and filter network 15 is constructed such that, in combination with the coil/plasma load, it provides a desired impedance at start-up, and a desired steady-state impedance. The transformed impedance Z is shown as curve Z in FIG. 3. The following equation describes the relationship between the supply voltage ($V_{DD}$), the power input to the coil (P), and the real part of the transformed impedance of the coil (Z).

$$P=\frac{2\,V_{DD}^2}{\pi^2 Z} \tag{1}$$

thus $$Z=\frac{2\,V_{DD}^2}{\pi^2 P} \tag{2}$$

The power P to the coil network 7 should be high at start-up so that the start-up time of the lamp is minimized. However, the power P should not exceed 25 watts because the power supply electronics may be excessively overdriven, and therefore damaged. Applying equation 2, and assuming $V_{DD}$ is between 55 and 80 volts, we find that at start-up Z should be between approximately 25 and 50Ω. Thus, to avoid damages associated with extended overdriving of the power supply while ensuring a quick on-time, impedance matching and filter network 15 is designed to ensure that the total reflected impedance seen by amplifier 14 at start-up is approximately 45Ω.

For steady-state operation, where P equals 19 watts, the transformed impedance Z should be about 180Ω. Thus, impedance matching and filter network 15 is designed to provide a transformed impedance Z of 180Ω during steady-state operation. Impedance matching and filter network 15 is also designed to provide maximum power transfer efficiency when the lamp operates in the steady-state.

The design of impedance matching and filter networks for providing preselected impedance transformations at start-up and during steady-state operation is described in detail in the above-referenced application Ser. No. 07/887,166, filed May 20, 1992, now abandoned, and U.S. Pat. No. 5,541,482, issued Jul. 30, 1996.

$P_{rf}$ represents the power per unit area (mW/cm$^2$) incident the surface of amalgam 10. When a sample of material is emersed in a plasma, the sample will be heated by a plasma-generated sheath surrounding the sample. The sheath surrounding amalgam 10 when amalgam 10 is emersed in plasma 9 is approximately 0.1 cm thick. This thickness, when multiplied by the power density in lamp vessel 1, yields the power per unit area supplied to amalgam 10 by plasma 9. In this embodiment of the invention, the power input to the bulb at steady-state is 19 W and the volume of lamp vessel 1 is approximately 200 cm$^3$. Thus, the power density is 19 W÷200 cm$^3$, or approximately 0.1 W/cm$^3$. Multiplying this figure by the sheath thickness gives 0.1 W/cm$^3$×0.1 cm =0.01 W/cm$^2$, or 10 mW/cm$^2$.

Finally, $P_\epsilon$ represents the power per unit area radiated by the surface of amalgam 10 in mW/cm$^2$. Under the Stefan-Boltzmann law, $P_\epsilon$ is a function of the emissivity and the temperature of amalgam 10. The relationship is expressed as:

$$P_\epsilon=\epsilon\sigma T^4 \tag{3}$$

where $\epsilon$ is the emissivity of amalgam 10, $\sigma$ is a constant $5.67\times10^{-9}$ mW/cm$^2$K$^4$, and T is the temperature of amalgam 10 on the Kelvin scale. Noting that $\epsilon\sigma$ is a constant k for a given sample of amalgam, equation 3 reduces to:

$$P_\epsilon=kT^4 \tag{4}$$

Thus, $P_\epsilon$ is proportional to the fourth power of the temperature of amalgam 10.

Figure 4:
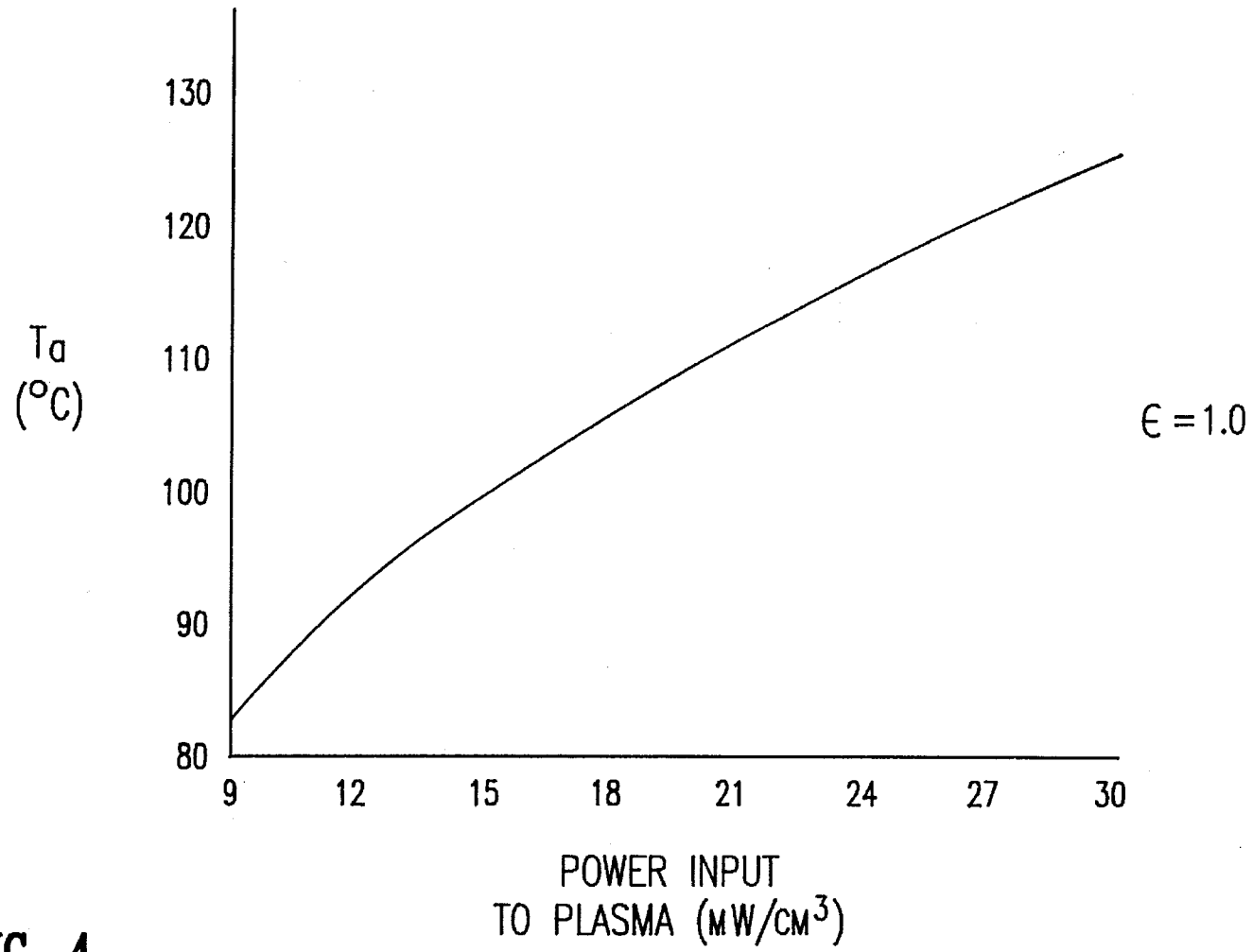
FIG. 4 shows the variation of amalgam temperature at different levels of power input to the plasma, assuming that the amalgam is a black body ($\epsilon$=1.0)

FIG. 4, for purposes of illustration, shows by inference the strong relationship between the power radiated by a black body and the temperature of the black body. The curves shown in FIG. 4 are similar to those of amalgam 10, but the emissivity $\epsilon$ for a black body is 1.0, whereas the emissivity of amalgam 10 is approximately 0.2. This difference results in higher equilibrium temperatures for amalgam 10 given the same level of power input.

As shown in FIG. 4, when the power input to the plasma is 9 mW/cm$^3$, the body heats to approximately 85° C. before the power radiated from the black body is equal to the power absorbed by the black body from the plasma. When the power input to the plasma is 30 mW/cm$^3$, the body heats to approximately 125° C. Thus, a 333% increase in applied power results in only a 40° C. change in the equilibrium temperature. This temperature stability is important in applications requiring dimmable or multi-stage lamps because the power input to the lamp may be adjusted across a broad range while keeping the amalgam near the temperature resulting in the most efficient light output.

Figure 5:
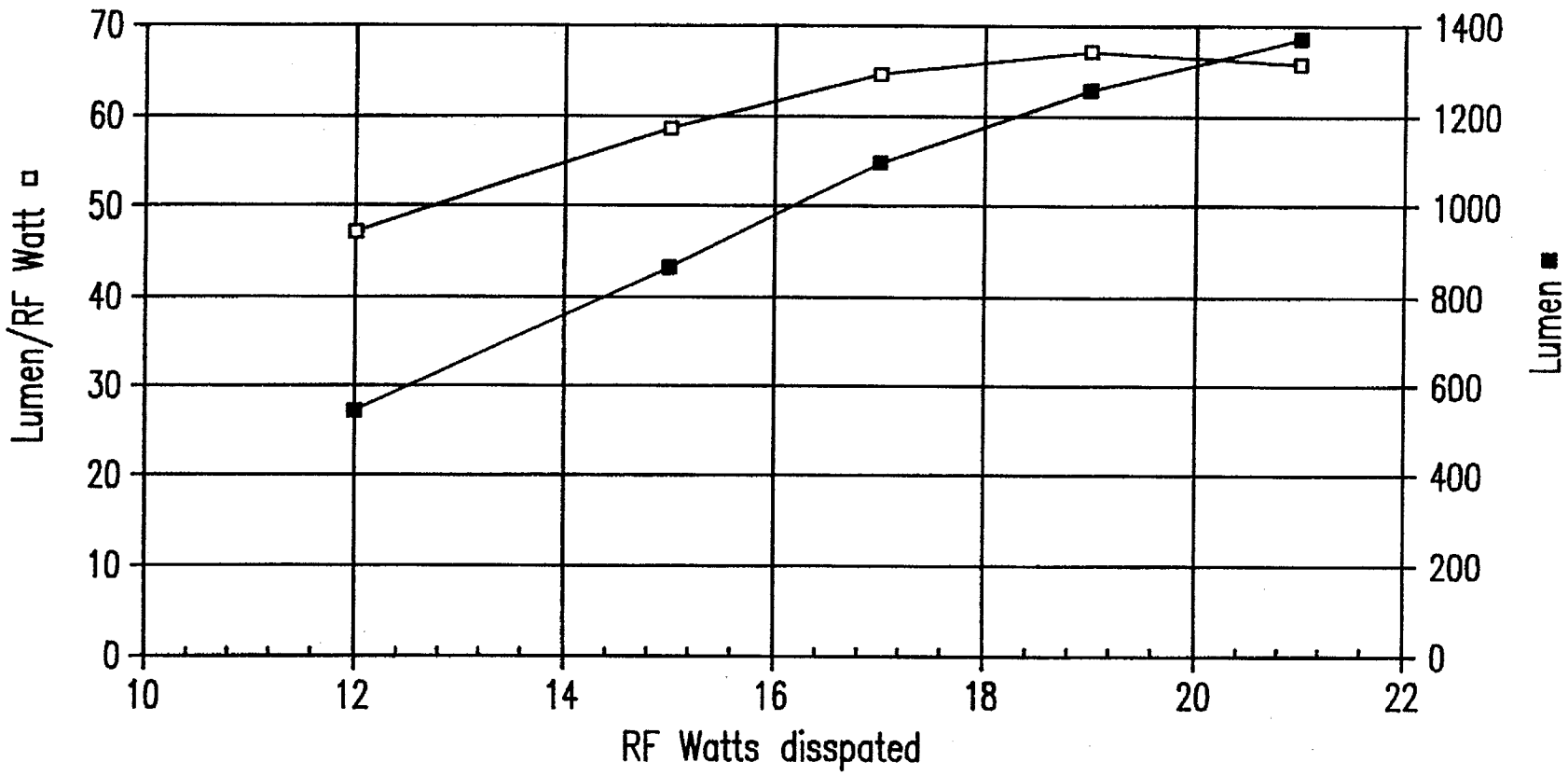
FIG. 5 shows the relationship between light output and efficiency over a range of input power for a lamp in accordance with the first embodiment of the invention.

FIG. 5 shows the relationship between light output (in lumens) and efficiency (in lumens per RF Watt) over a range of power input to a lamp in accordance with the present invention. This particular lamp is designed to provide peak efficiency at 19 W.

As may be observed in FIG. 5, when the input power is decreased from 21 to 12 Watts, the light output decreases from approximately 1370 lumens to approximately 550 lumens, which represents a 60% decrease in light output. Also, as a result of the decreased power input, the lamp efficiency decreases from approximately 65 to approximately 46 lumens per RF Watt, which represents only a 29% decrease in lamp efficiency. Thus, such a lamp may be operated over a range of light output levels without a severe decrease in lamp efficiency.

The cross-sectional area and thermal conductivity of supporting member 11 should be selected so that when the lamp is energized the thermal power conducted away from control amalgam 10 via supporting member 11 is less than 1% of the thermal power lost via thermal (infrared) radiation. With amalgam 10 thus insulated from lamp vessel 1, the temperature of amalgam 10 is essentially determined by the power $P_{rf}$ transferred to it from plasma 9 and the power $P_\epsilon$ radiated from it via infrared radiation. Referring again to FIG. 3, if $P_{rf}$ is greater than $P_\epsilon$, then the temperature of amalgam 10 will increase. Conversely, if $P_{rf}$ is less than $P_\epsilon$, the temperature of amalgam 10 will decrease. The operating point OP, defined by the intersection of curves $P_{rf}$ and $P_\epsilon$, is the point at which $P_{rf}$ is equal to $P_\epsilon$. Operating point OP determines the steady-state temperature SS of amalgam 10. As stated above, the impedance matching and filter network 15 and amalgam 10 are designed so that the steady-state temperature SS of amalgam 10 is at or near the temperature necessary to provide mercury vapor pressure of 6 mTorr, resulting in maximum light output efficiency.

FIG. 3 shows that when the temperature of amalgam 10 is low, as when the lamp is first energized, $P_{rf}$ is far greater than $P_\epsilon$. Since the power $P_{rf}$ being transferred to amalgam 10 is much greater than the power $P_\epsilon$ being radiated away, amalgam 10 heats rapidly toward steady-state temperature SS.

An increase in the temperature of amalgam 10 beyond steady-state temperature SS causes the transformed impedance Z to increase, resulting in a decrease in the power $P_{rf}$ transferred to amalgam 10. Also because of an increase in the temperature of amalgam 10, the power radiated $P_{\epsilon}$ by amalgam 10 will increase. Thus, when the temperature of amalgam 10 is above the steady-state temperature SS, the power $P_{rf}$ available to heat amalgam 10 is less than the power $P_{\epsilon}$ radiated from amalgam 10 so that amalgam 10 experiences a net power loss. Consequently, amalgam 10 cools toward steady-state temperature SS.

Conversely, a decrease in the temperature of amalgam 10 from steady-state temperature SS causes the transformed impedance Z to decrease, resulting in an increase in the power $P_{rf}$ transmitted to amalgam 10 by plasma 9. In addition, the decrease in the temperature of amalgam 10 results in a decrease in the power radiated $P_{\epsilon}$ from amalgam 10. Thus, the system responds to the decrease in the temperature of amalgam 10 from steady-state temperature SS by decreasing the power radiated from amalgam 10 and increasing the power transferred to amalgam 10 so that amalgam 10 experiences a net power gain. Consequently, amalgam 10 is heated toward steady-state temperature SS.

Figure 6:
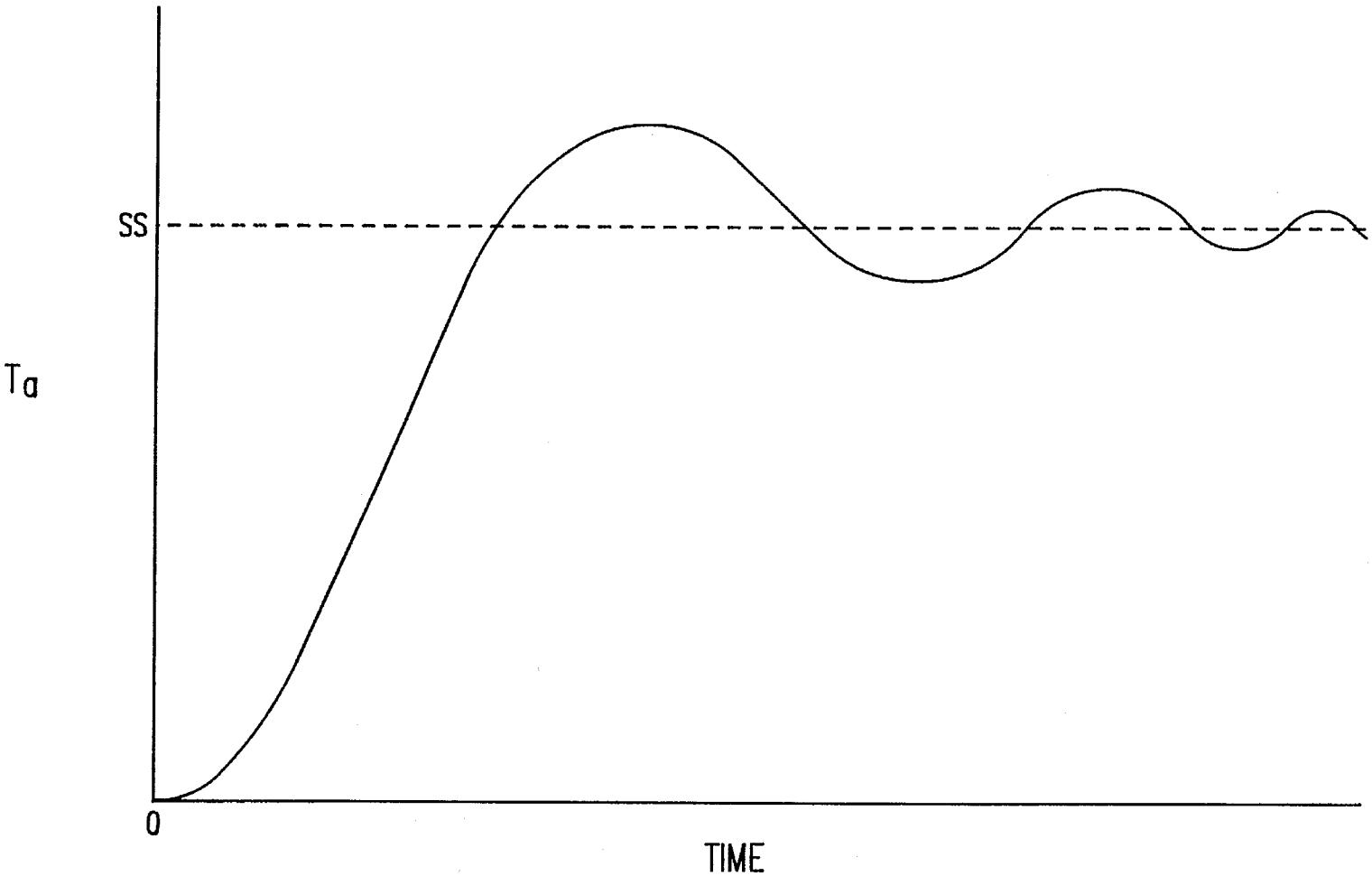
FIG. 6 shows a theoretical start-up response of the temperature of an amalgam in accordance with the first embodiment of the present invention.

FIG. 6 shows a theoretical start-up response of the temperature $T_a$ of amalgam 10. When the lamp is energized at time 0, the power transferred to amalgam 10 by plasma 9 quickly heats amalgam 10, thereby increasing the temperature $T_a$ toward the steady-state temperature SS. Because feedback is not instantaneous, the temperature $T_a$ of amalgam 10 overshoots steady-state temperature SS before the feedback system has time to compensate for the excess temperature. As the feedback system responds, the temperature $T_a$ of amalgam 10 will decrease toward steady-state temperature SS, again overshooting steady-state temperature SS. This cycle will continue until the temperature $T_a$, of amalgam 10 settles on steady-state temperature SS.

As a result of the aforementioned behavior, the steady-state temperature SS of amalgam 10 will be self-regulating, and largely independent of ambient temperature over a broad range of ambient temperatures.

Figure 7:
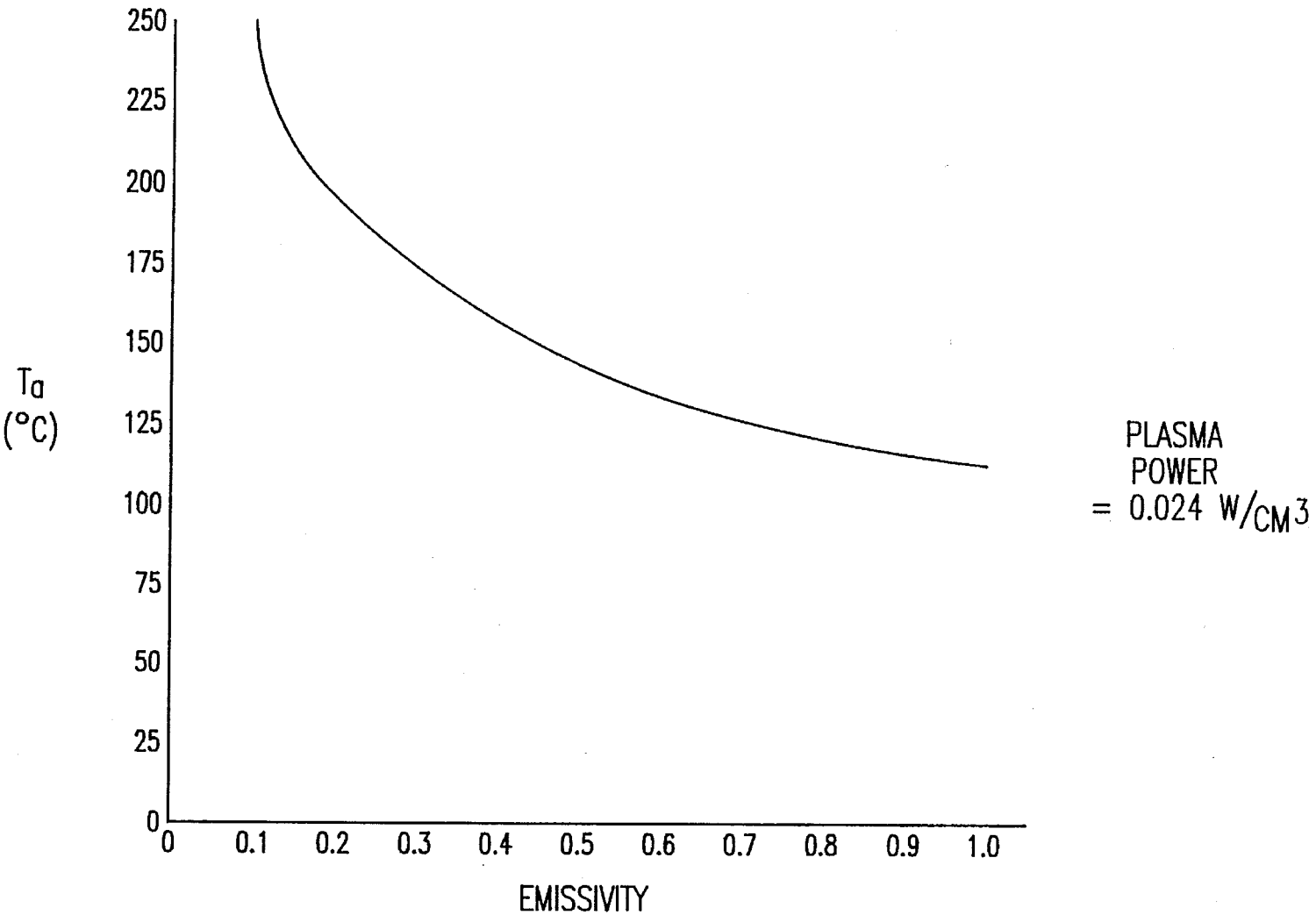
FIG. 7 shows the variation of amalgam temperature for different amalgam emissivities given a constant power input to the plasma.

FIG. 4, as discussed above, assumes a material with an emissivity $\epsilon$ of 1.0. In reality, the emissivity $\epsilon$ of an amalgam may be much less (e.g., 0.2). As shown in FIG. 7, which shows amalgam temperature as a function of emissivity at a constant power input to the plasma, this means that the amalgam temperature may be much higher than is desired.

An amalgam capable of controlling mercury vapor pressure while being heated directly by a plasma may be obtained by providing an amalgam with a cladding of a highly-emissive material, and thus improving the amalgam's ability to radiate heat. The cladding should be thin, approximately 0.2 mm in one embodiment, to minimize the insulating effect on the amalgam, and must leave a portion of the amalgam exposed to the inside of the lamp vessel to allow mercury to transfer to and from amalgam 10. Intimate contact between the amalgam and the cladding allows heat to be removed from the amalgam via conduction, which provides much more efficient heat transfer than radiation. Once the heat is conducted through the cladding, it is radiated away by the highly-emissive cladding surface.

For example, if an amalgam-forming metal of pure Indium, having an emissivity of approximately 0.2, is inserted into a glass enclosure having an emissivity of approximately 0.9, the resulting combination will radiate heat more effectively than the amalgam-forming metal alone. As a result of the increased radiation of heat, the amalgam will operate at a lower temperature given a particular plasma load.

Figure 8:
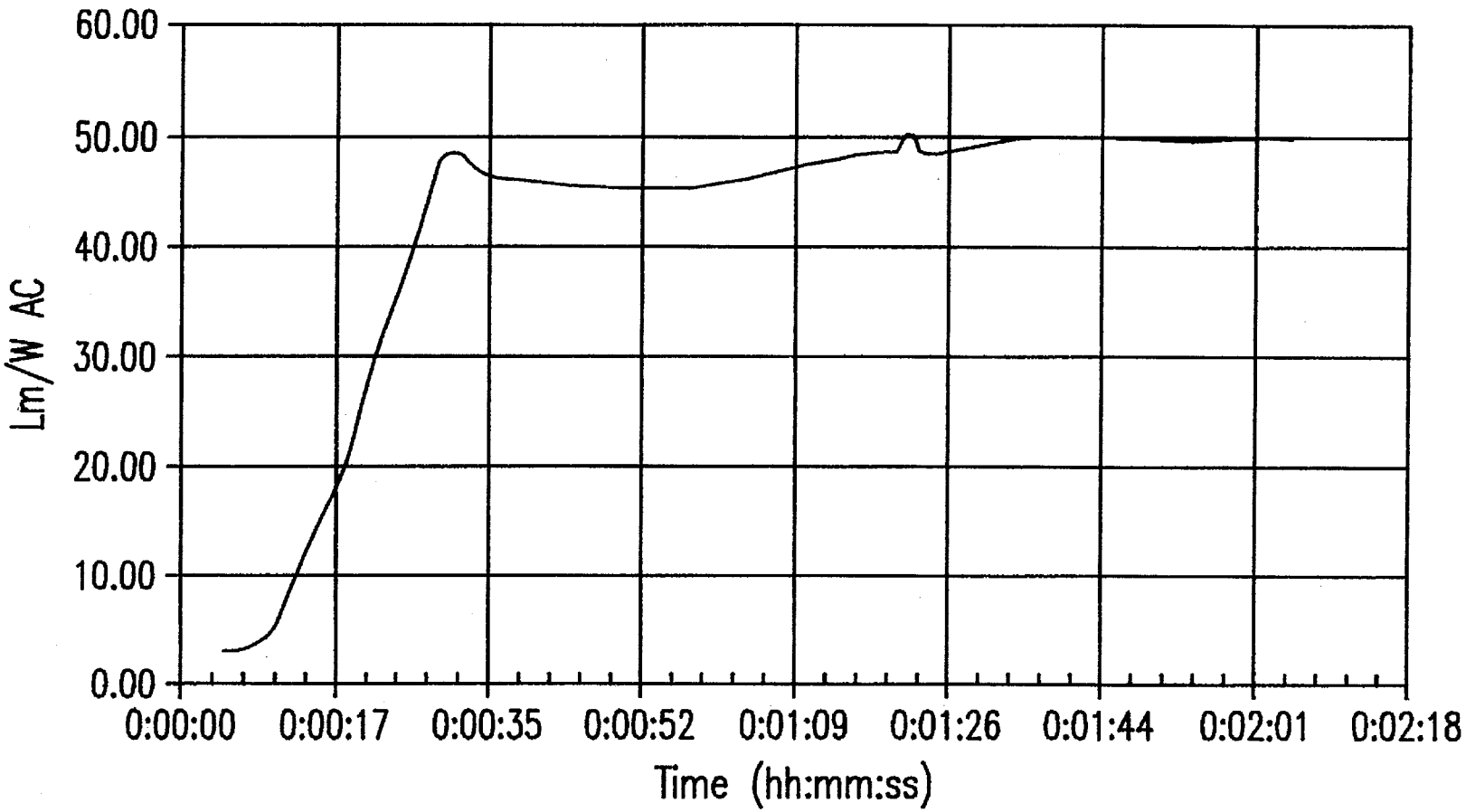
FIG. 8 shows the experimentally determined efficiency of a lamp constructed in accordance with the first embodiment of the invention.

FIG. 8 shows the experimentally determined efficiency of a lamp constructed in accordance with this embodiment of the present invention. Such a lamp typically reaches 80% of its maximum efficiency within 30 seconds.

Figure 9:
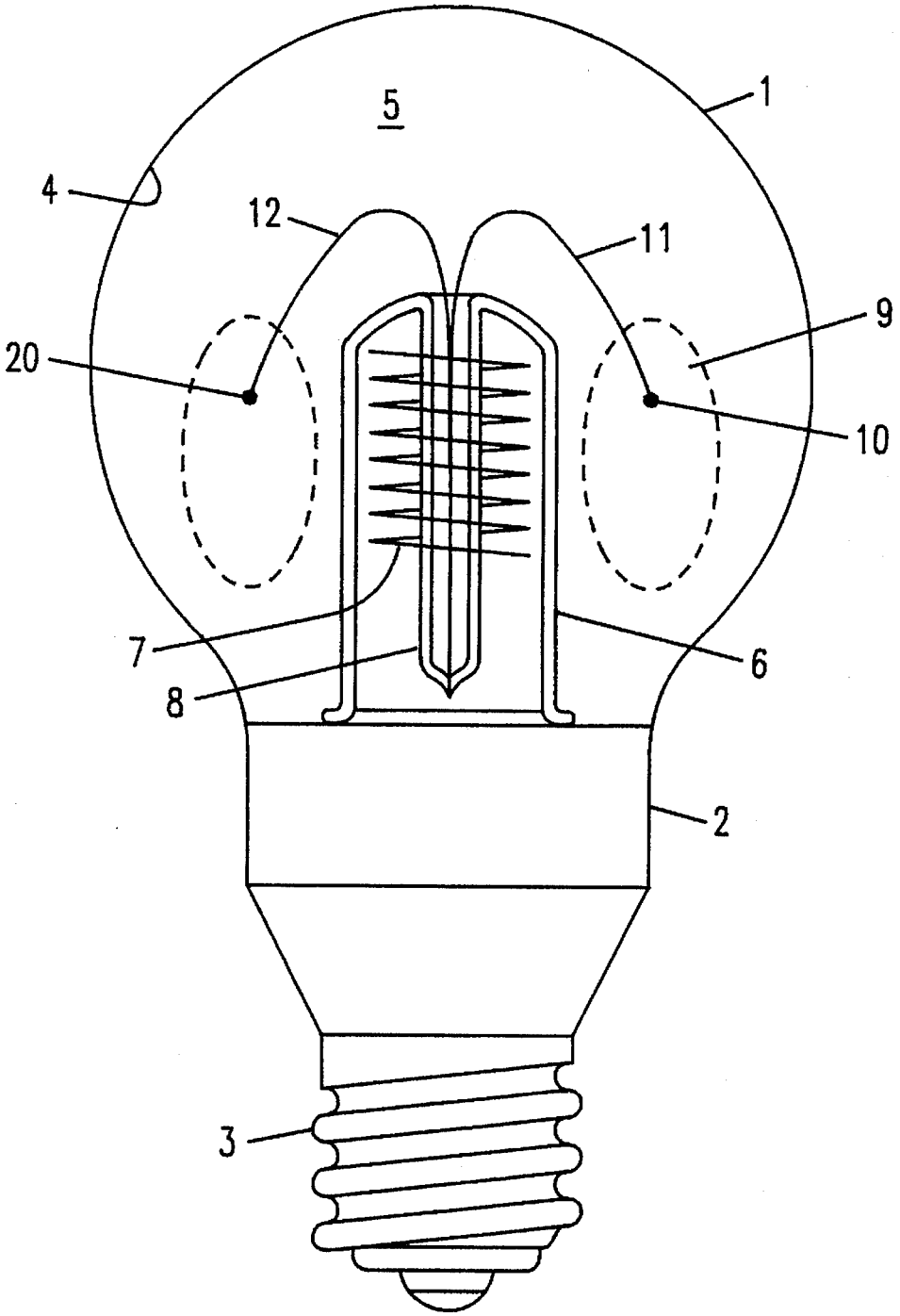
FIG. 9 shows a partial cross-sectional view of an electrodeless discharge lamp using a dual amalgam system in accordance with a second embodiment of the invention.

FIG. 9 shows a partial cross-sectional view of an electrodeless discharge lamp using a dual amalgam system in accordance with another embodiment of the present invention. The operation of this embodiment is substantially the same as the previous embodiment, except that in this electrodeless discharge lamp, a second amalgam sample, start-up amalgam 20, is suspended in plasma 9 by a supporting member 12. Supporting member 12 is typically of a construction similar to that of supporting member 11.

Start-up amalgam 20 is disposed on one end of supporting member 12 so that start-up amalgam 20 is within the electric discharge formed in lamp vessel 1, and consequently within plasma 9, when coil network 7 is energized. Further, start-up amalgam 20 is positioned opposite control amalgam 10 to slow the speed at which control amalgam 10 collects the mercury released by start-up amalgam 20, and therefore provide the necessary time for control amalgam 10 to warm up before control amalgam 10 gains control of the mercury vapor pressure in lamp vessel 1.

Like control amalgam 10, start-up amalgam 20 is heated by plasma 9. To provide a fast start-up response, start-up amalgam 20 should be small and have maximum surface area. In a preferred embodiment of the present invention, the surface area of a small amalgam sample, approximately 5 to 10 mg, is maximized to ensure a fast start-up.

Figure 10:
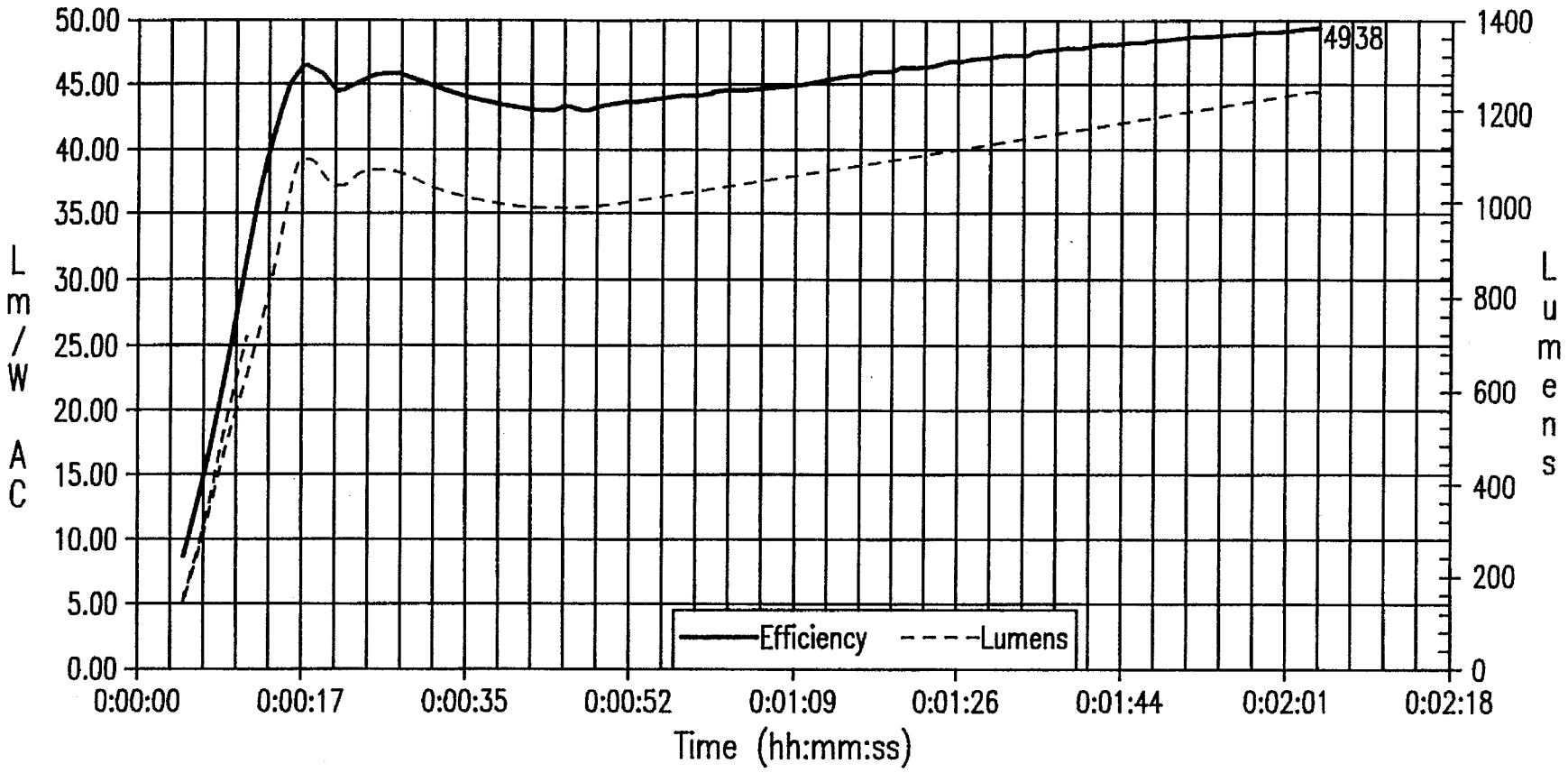
FIG. 10 shows the experimentally determined efficiency and light output from start-up of the lamp using a dual amalgam system.

Start-up amalgam 20, typically formed using an amalgamating metal of pure indium, has a lower operating temperature than control amalgam 10, so that after the lamp is switched on, essentially all of the mercury of start-up amalgam 20 is quickly released into lamp vessel 1. In this way, the mercury vapor pressure inside lamp vessel 1 rises rapidly so that a comparatively high light output is obtained a short time after the lamp has been switched on. FIG. 10 shows the experimentally determined efficiency and light output from start-up of the lamp using a dual amalgam system. A lamp using the above-described dual amalgam system typically provides a light output of 80% of maximum within 10 seconds of start-up.

Control amalgam 10 consists of 30 to 60 mg of a high-temperature amalgamating metal of a composition similar to that described in connection with the first embodiment of the present invention. At operating temperatures, control amalgam 10 retains substantially all the mercury that is not in the gas phase. Therefore, the proper ratio of mercury dispensed in lamp vessel 1 to control amalgam 10 must be selected so as not to saturate control amalgam 10. In one embodiment, 2.5 to 4.0 mg of mercury are dispensed in lamp vessel 1. Control amalgam 10 controls mercury vapor pressure during lamp operation in much the same way as described above with regard to the single amalgam system.

Figure 11:
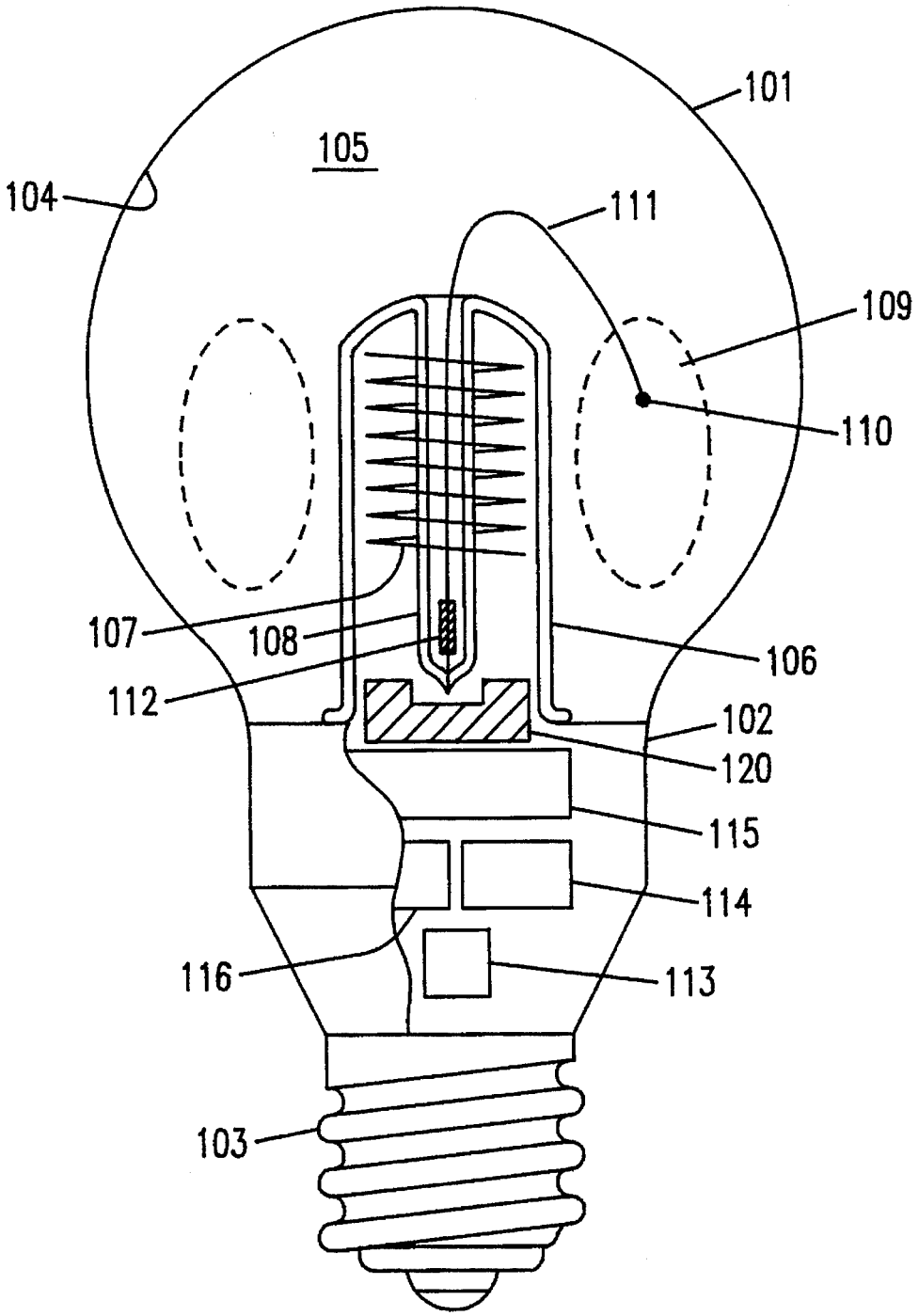
FIG. 11 shows a partial cross-sectional view of a third embodiment of the invention.

FIG. 11 represents a third embodiment in accordance with the present invention. This electrodeless discharge lamp comprises a glass lamp vessel 101, a power supply housing 102, and a threaded base 103. Threaded base 103 is adaptable to a standard light socket.

Lamp vessel 101 is sealed from the environment and contains a gas mixture 105 consisting of mercury vapor and a rare gas. A phosphor coating 104 is disposed on the inner surface of lamp vessel 101 for converting ultraviolet radiation into visible light. A tubular indentation 106 extends into lamp vessel 101. Extending coaxially through tubular indentation 106 is a tipoff tube 108, which is sealed at its lower end during manufacture and open to the inside of lamp vessel 101. A coil network 107, disposed within tubular indentation 106 and surrounding tipoff tube 108, is provided to induce a plasma 109 in gas mixture 105 when power is applied to coil network 107. Extending through tipoff tube 108 and into lamp vessel 101 is a supporting member 111, preferably made of a thermally nonconductive material, for supporting a start-up amalgam 110 and a control amalgam 112. In this embodiment, start-up amalgam 110 and control amalgam 112 are both formed of indium, which provides an acceptable level of mercury vapor pressure at temperatures ranging from approximately 80° to 140° C. Supporting member 111 is a strand of glass, approximately 0.5 mm in diameter.

Start-up amalgam 110 is disposed on one end of supporting member 111 so that start-up amalgam 110 is within the electric discharge formed in lamp vessel 101, and consequently within plasma 109, so that start-up amalgam 110 is heated when coil network 107 is energized.

To provide a fast start-up response, start-up amalgam 110 should be small and have a maximum surface area. The amalgam sample weighs 5 to 10 mg in one embodiment of the invention.

Control amalgam 112 is disposed on supporting member 111 near the sealed end of tipoff tube 108. Control amalgam 112 is thermally insulated from the ambient environment by the vacuum in lamp vessel 101 and by a heat dam 120, which also serves as a thermal barrier between control amalgam 112 and the power supply electronics. In a preferred embodiment, heat dam 120 includes two silicone rubber disks separated by an air gap. In another embodiment, heat dam 120 is a single silicone rubber disk approximately 0.25 inches thick. Thus insulated from the ambient environment, control amalgam 112 exhibits a stable operating temperature, typically between 140° and 160° C., over a wide range of ambient temperatures.

When the lamp operates in the steady-state, control amalgam 112 retains substantially all the mercury that is not in the gas phase. Therefore, the proper ratio of mercury dispensed in lamp vessel 101 to control amalgam 112 must be selected so as not to saturate control amalgam 112. In one embodiment of the present invention, 2.5 to 4.0 mg of mercury are dispensed in lamp vessel 101, and control amalgam 112 comprises 34 to 38 mg of indium.

Power supply housing 102 contains an oscillator 113 for providing an RF signal. RF amplifier 14 receives the RF signal from oscillator 113 and amplifies it to a usable level. An impedance matching and filter network 115 matches the output impedance of RF amplifier 114 to the reflected impedance of the load of plasma 109 and coil network 107, and filters unwanted harmonics from the amplified RF signal. A power supply 116 provides power to oscillator 113 and RF amplifier 114.

Figure 12:
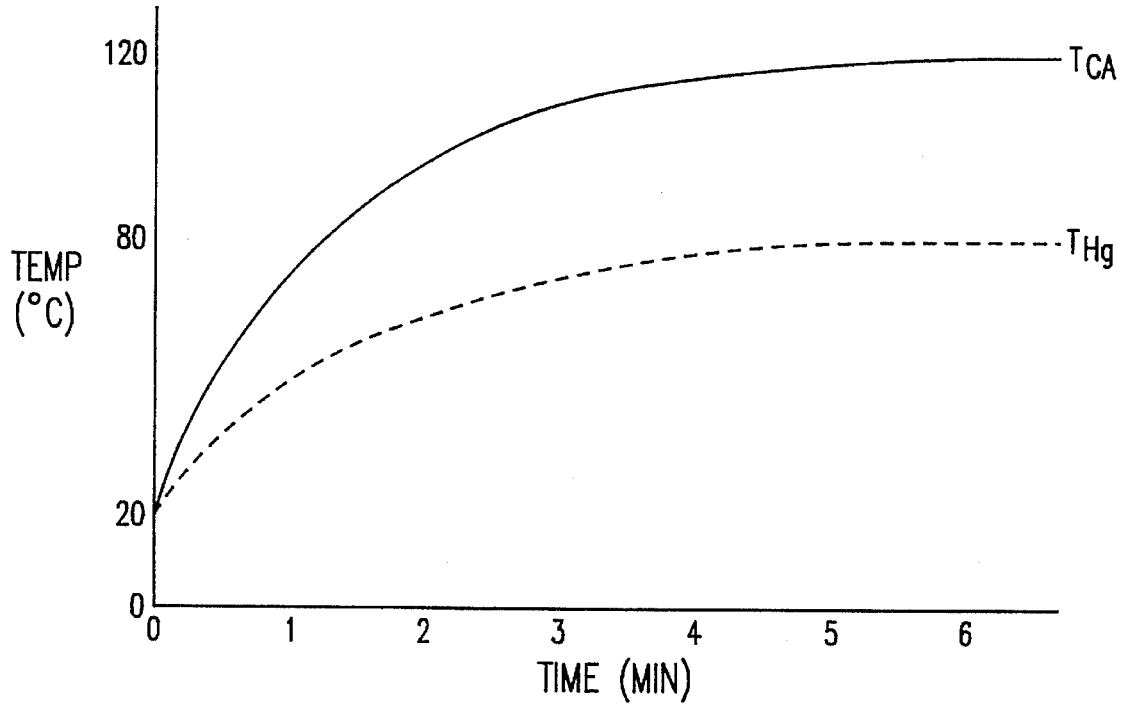
FIG. 12 shows the variation of the respective temperatures of the control amalgam and the surface of the lamp vessel in the third embodiment, as the lamp heats from room temperature after it is energized.
Figure 13:
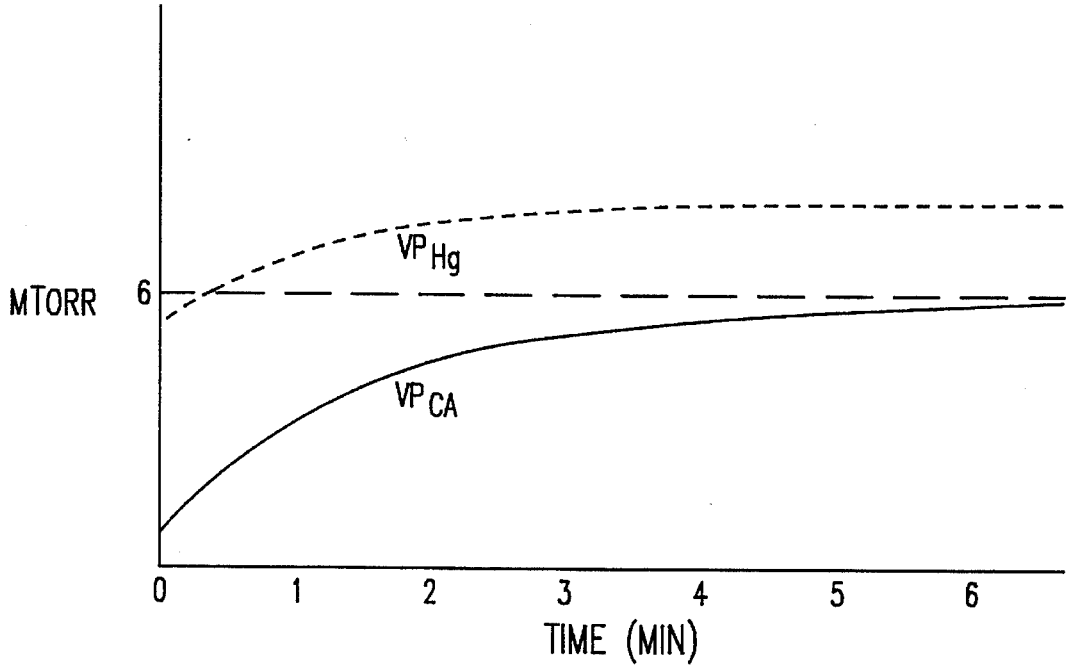
FIG. 13 shows the variation of the mercury vapor pressure corresponding to the temperatures of the surface of the lamp vessel and the control amalgam shown in FIG. 12.
Figure 14:
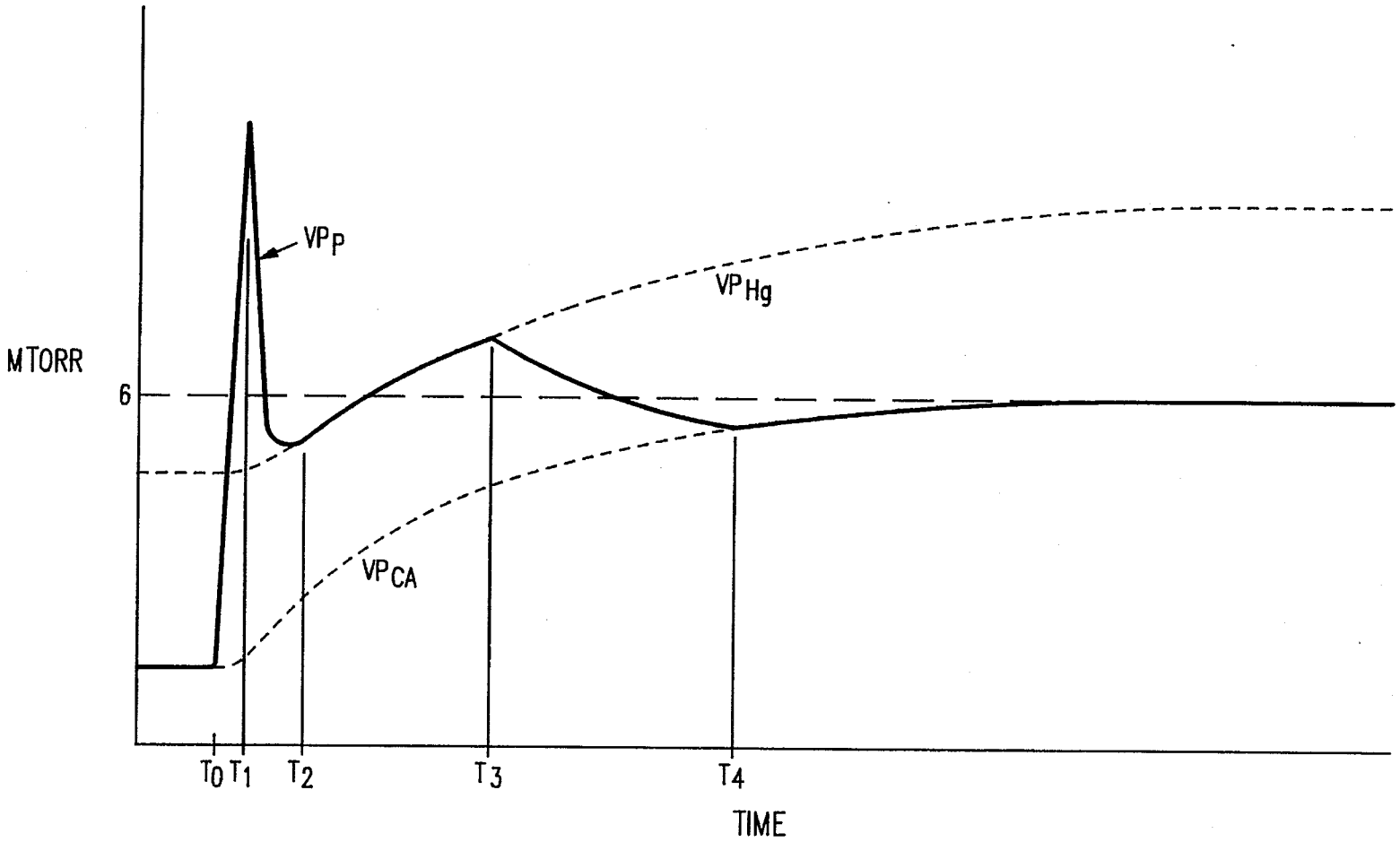
FIG. 14 shows how the mercury vapor pressure in the plasma varies in a lamp in accordance with the third embodiment of the invention, as the lamp warms from room temperature to the lamp's steady-state temperature.

FIGS. 12 and 13 illustrate the behavior of several variables as a function of time and form the basis for FIG. 14, which describes the partial pressure of the mercury from start-up to steady state.

FIG. 12 shows the temperature of control amalgam 112 and a surface of lamp vessel 101 as the lamp heats from room temperature after it is energized. The curve $T_{CA}$ represents the temperature of control amalgam 112: the curve $T_{Hg}$ represents the temperature of lamp surfaces, and therefore pure mercury condensed on lamp surfaces.

The temperature of the external surface of lamp vessel 101 is dependent on the ambient temperature. In one embodiment, the external lamp surface reaches approximately 80° C. when the lamp operates in a room temperature (approximately 22° C.) ambient environment. Since control amalgam 112 is thermally insulated from the ambient environment, control amalgam 112 heats more quickly, and reaches a higher equilibrium temperature, than the surface of lamp vessel 101. In one embodiment, the equilibrium temperature of control amalgam 112 is approximately 140° C.

FIG. 13 shows the increases in the mercury vapor pressure that accompany the temperature changes shown in FIG. 12. Mercury condensed on a surface of lamp vessel 101 will have the same temperature as the surface. Thus, the vapor pressure of the pure condensed mercury will be a function of the surface temperature. The line $VP_{Hg}$ represents the mercury vapor pressure assuming the mercury is condensed on a surface of lamp vessel 101, and the surface is heated as shown in FIG. 13.

The mercury vapor pressure above control amalgam 112 is a function of the temperature of control amalgam 112. Curve $VP_{CA}$ represents the vapor pressure of mercury above control amalgam 112 when control amalgam 112 is heated as in FIG. 13. FIGS. 12 and 13 show that control amalgam 112 produces a lower mercury vapor pressure than pure mercury at lamp surface temperatures when the lamp operates in the steady-state, even though control amalgam 112 has a higher operating temperature than lamp surfaces.

FIG. 14 shows how the mercury vapor pressure in plasma 109 varies as the lamp warms from room temperature to the lamp's steady-state temperature. The solid line $VP_P$ represents the mercury vapor pressure in the vicinity of plasma 109 as the lamp heats to its steady-state temperature. The curve $VP_{CA}$, as discussed above in connection with FIG. 13, represents the mercury vapor pressure that would be provided by control amalgam 112 if it controlled the mercury vapor pressure at all times. $VP_{CA}$ is dependent on the temperature of control amalgam 112. The curve $VP_{Hg}$, also discussed above in connection with FIG. 13, represents the mercury vapor pressure that would be provided if pure mercury condensed on lamp surfaces controlled the mercury vapor pressure at all times during lamp operation.

Assuming the lamp has been off for some time, all elements of the lamp will be at the same temperature. Since start-up amalgam 110 and control amalgam 112 are both of the same composition and at the same temperature before the lamp is energized, and since the mercury vapor pressure above start-up amalgam 110 and control amalgam 112 is lower than that above pure mercury at a given temperature, start-up amalgam 110 and control amalgam 112 dictate the mercury vapor pressure in lamp vessel 101 when the lamp is off. As shown in FIG. 14, before the lamp is energized at time 0 the mercury vapor pressure $VP_P$ will be that of control amalgam 112 at room temperature.

As discussed above regarding FIG. 1, optimal light output is obtained when the mercury vapor pressure is 6 mTorr. FIG. 14 shows that if the mercury vapor pressure were controlled only by pure mercury, as illustrated by the curve $VP_{Hg}$, the mercury vapor pressure would be near optimal during start up, but would eventually rise far beyond the optimal 6 mTorr level. If the mercury vapor pressure were controlled solely by control amalgam 112, the mercury vapor pressure would be far below the optimal 6 mTorr level at start-up, resulting in a slow start-up response. Thus, the lamp is designed to provide mercury vapor pressure control via pure mercury condensed on cool lamp surfaces for a specified period during warm-up, and subsequently transfer mercury vapor pressure control to control amalgam 112 when control amalgam 112 is at a temperature sufficient to provide acceptable levels of mercury vapor pressure. The following discussion describes the operation of a dual amalgam system in accordance with this embodiment of the present invention.

Because start-up amalgam 110 absorbs energy directly from the electric discharge of coil network 107 and from plasma 109, start-up amalgam 110 is quickly heated so that substantially all the mercury in start-up amalgam 110 is released into lamp vessel 101. This results in a rapid increase in mercury vapor pressure, which is illustrated by the rapid rise of $VP_P$ from $T_0$ to $T_1$ of FIG. 14.

When the lamp has been off for a long period, from 3 to 15% of the mercury dispensed within lamp vessel 101 will reside in start-up amalgam 110. This quantity of mercury is such that when it is released into lamp vessel 101 at start-up, the mercury vapor pressure in lamp vessel 101 will be substantially greater than the mercury vapor pressure above control amalgam 112 and the mercury vapor pressure of pure mercury at the relatively cool lamp surface temperatures. Thus, mercury will rapidly condense on cool lamp surfaces and begin to combine with control amalgam 112. Because control amalgam 112 is positioned such that the time constant of diffusion to control amalgam 112 (i.e., the time it takes mercury atoms to reach and combine with control amalgam 112) is far greater than the time constant of diffusion to nearby lamp surfaces, the vast majority of mercury removed from the gas phase is initially condensed on the cool lamp surfaces. This condensation of mercury results in a rapid decline in mercury vapor pressure, as illustrated by the rapid fall of $VP_P$ from $T_1$ to $T_2$ of FIG. 14.

As lamp vessel 101 continues to warm-up, control amalgam 112 collects mercury from the gas phase as control amalgam 112 approaches its operating temperature. As control amalgam 112 collects mercury, mercury condensed on lamp surfaces vaporizes to replace the mercury collected from the gas phase by control amalgam 112, thereby controlling the mercury vapor pressure $VP_P$ in plasma 109. This period of lamp surface control is represented by the segment of mercury vapor pressure line $VP_P$ between $T_2$ and $T_3$ of FIG. 14.

Eventually, the lamp surfaces will be devoid of mercury. This point is labeled $T_3$ in FIG. 14. Control amalgam 112 will continue to collect mercury, resulting in a decline of mercury vapor pressure $VP_P$ as shown from $T_3$ to $T_4$ of FIG. 14. This decline stops when the mercury vapor pressure $VP_P$ of lamp vessel 101 is that of control amalgam 112. After $T_4$, control amalgam 112 controls the mercury vapor pressure in lamp vessel 101.

As may be observed in FIG. 14, if control amalgam 112 gains control of the mercury vapor pressure too soon (e.g., shortly after $T_2$), control amalgam 112 will be cool relative to its operating temperature, and thus the mercury vapor pressure will be far below the optimal 6 mTorr level. This will result in poor start-up characteristics of the lamp. Conversely, if control amalgam 112 gains control of the mercury vapor pressure too late (e.g., long after $T_3$), the mercury vapor pressure will be far above the optimal 6 mTorr level for a period of time, again resulting in a lamp having poor start-up characteristics.

For the aforementioned reasons, the lamp is designed to optimize the time period before which control amalgam 112 gains control of the mercury vapor pressure (i.e., the time from $T_0$ to $T_4$ in FIG. 14) so that control amalgam 112 will gain control of the mercury vapor pressure only when control amalgam 112 is warm enough to provide an acceptable level of mercury vapor pressure.

To accomplish effective mercury vapor pressure control during the warm-up period of the lamp, the time required for control amalgam 112 to collect sufficient mercury to deplete the lamp surfaces of condensed mercury is matched to the warm-up time of control amalgam 112, so that control of mercury vapor pressure will transfer from lamp surfaces to control amalgam 112 only after control amalgam 112 has had time to heat to an appropriate temperature.

The thermal time constant of control amalgam 112 dictates how long it will take control amalgam 112 to reach operating temperature, and is primarily a function of the combined mass of tipoff tube 108 and tubular indentation 106, the thermal energy dissipated by coil network 107, and the energy radiated by plasma 109.

The amount of power available to heat the lamp, and particularly the combined mass of tipoff tube 108 and tubular indentation 106, is determined by subtracting the power emitted by the lamp in the form of light from the RF power supplied to the lamp. For example, when 19 Watts of RF power is provided to a lamp in accordance with one embodiment of the invention, the lamp emits 4 Watts of light. Thus, 15 Watts (19 W–4 W) are available to heat the lamp. In such an embodiment, control amalgam 112 typically reaches 100° C. in approximately 2 minutes.

The diffusion time constant determines how fast control amalgam 112 collects mercury atoms from lamp vessel 101, and is primarily a function of the length and cross-sectional area of tipoff tube 108. Decreasing the cross-sectional area of tipoff tube 108 will decrease the rate at which mercury atoms enter tipoff tube 108, and therefore increase the diffusion time constant. Similarly, increasing the length of tipoff tube 108 will decrease the rate at which mercury atoms diffuse to control amalgam 112, and therefore increase the diffusion time constant. In one embodiment of the present invention, the length of tipoff tube 108 is 1.5 inches and the outside diameter is 6 mm (i.e., the cross-sectional area of tipoff tube 108 is approximately 30 $mm^2$).

Figure 15:
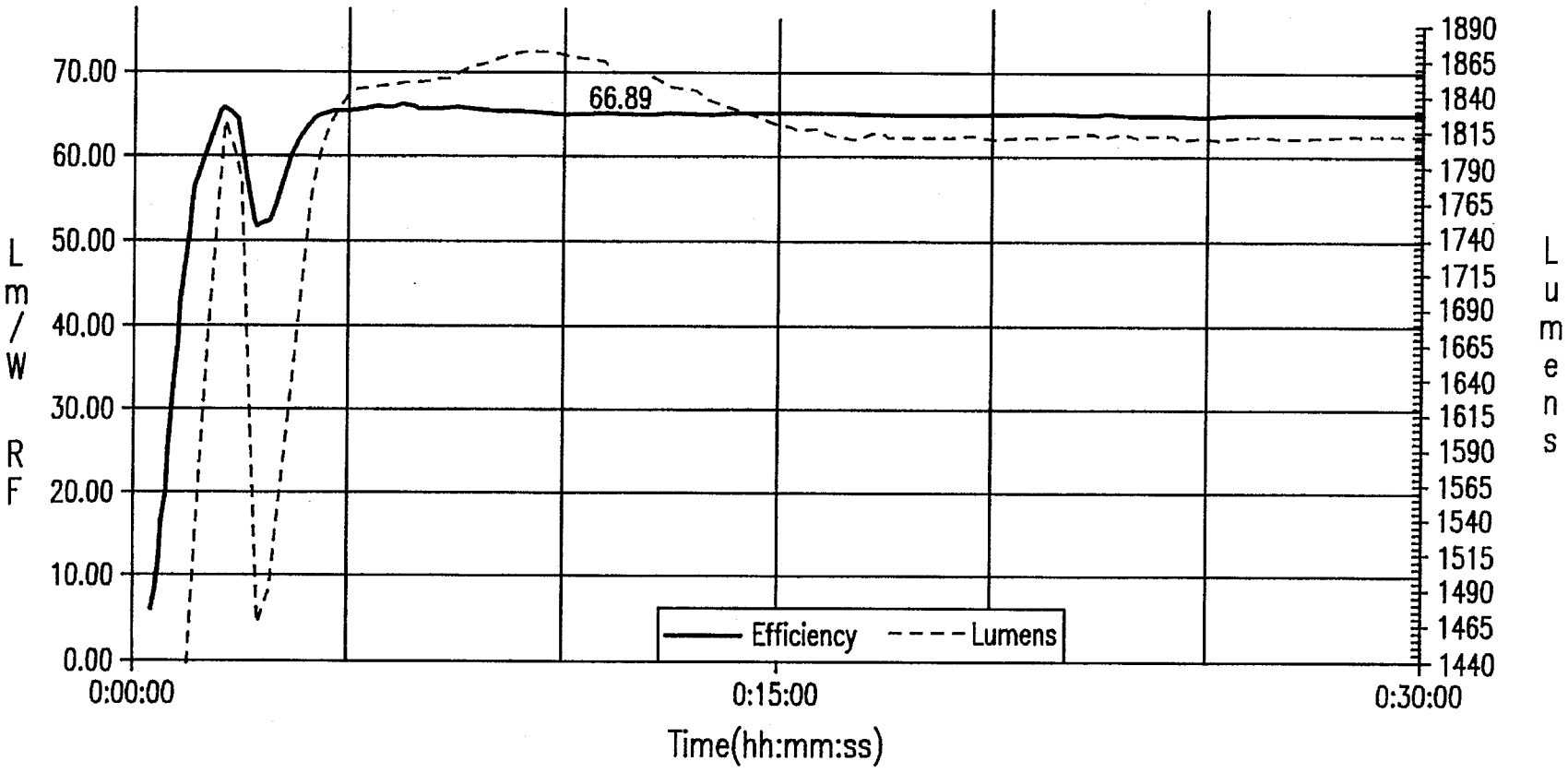
FIG. 15 shows the experimentally determined efficiency and light output in a lamp in accordance with the third embodiment of the invention, as the lamp warms from room temperature to the lamp's steady-state temperature.

FIG. 15 shows the experimentally determined efficiency and light output in a lamp in accordance with the third embodiment of the invention, as the lamp warms from room temperature to the lamp's steady-state temperature.

Although the present invention has been described in considerable detail with reference to certain preferred versions thereof, other versions are possible. Therefore, the spirit and scope of the appended claims should not be limited to the description of the preferred versions contained herein.

We claim:

1. An electrodeless discharge lamp having a radio frequency power source, said lamp comprising:

a sealed lamp vessel containing a gaseous mixture of mercury and a rare gas;

a coil network for inducing a high-frequency electromagnetic field into said mixture so as to induce a plasma in said gaseous mixture;

an impedance matching network between said power source and said coil network, said impedance matching network for providing a preselected power transfer function between said power source and said coil network;

a control amalgam disposed within said plasma; and a supporting member for supporting said control amalgam and thermally isolating said control amalgam from said vessel;

wherein said control amalgam controls the vapor pressure of said mercury during steady-state operation of said lamp.

2. The lamp of claim 1 wherein said electromagnetic field oscillates between 100 kHz and 30 MHz.

3. The lamp of claim 1 wherein said control amalgam comprises indium.

4. The lamp of claim 1 wherein said control amalgam comprises silver.

5. The lamp of claim 1 wherein said control amalgam comprises silver and indium.

6. The lamp of claim 5 wherein said control amalgam comprises an amalgamating metal of 10 to 20% silver by mass.

7. The lamp of claim 1 wherein said control amalgam is operative to control the vapor pressure of mercury within said vessel within the range of from 4.5 to 7.0 mTorr when the temperature of said amalgam is at one or more points within the temperature range of from 190 to 340 degrees C.

8. The lamp of claim 7 wherein said control amalgam is operative to control the vapor pressure of mercury within said vessel within the range of from 4.5 to 7.0 mTorr when the temperature of said control amalgam is about 220 degrees C.

9. The lamp of claim 1 wherein the mass of the control amalgam is in the range of from 60 to 90 mg.

10. The lamp of claim 1 wherein said supporting member comprises a glass strand.

11. The lamp of claim 1 wherein said impedance matching network provides for maximum power transfer when the temperature of said control amalgam is low, said power transfer decreasing as said control amalgam increases in temperature.

12. The lamp of claim 1 wherein said transfer function provides for maximum power transfer efficiency when said control amalgam is at a steady-state operating temperature.

13. The lamp of claim 1 wherein said coil network comprises a coil wound around a core of magnetic material.

14. The lamp of claim 1 further comprising a start-up amalgam sample disposed within said plasma.

15. The lamp of claim 14 wherein the mass of the start-up amalgam is in the range of from 5 to 10 mg.

16. The lamp of claim 14 further comprising a second supporting member for supporting said start-up amalgam sample and thermally isolating said start-up amalgam sample from said vessel.

17. The lamp of claim 14 wherein said start-up amalgam sample is substantially free of mercury during steady-state operation of said lamp.

18. The lamp of claim 14 wherein said start-up amalgam comprises indium.

19. The lamp of claim 16 wherein said second supporting member comprises a glass strand.

20. The lamp of claim 14 wherein said impedance matching network provides for maximum power transfer when the temperature of said control amalgam is low, said power transfer decreasing as said control amalgam increases in temperature.

21. The lamp of claim 14 wherein said transfer function provides for maximum power transfer efficiency when said control amalgam is at a steady-state operating temperature.

22. An electrodeless discharge lamp having a radio frequency power source, said lamp comprising:

a sealed lamp vessel containing a gaseous mixture of mercury and a rare gas;

a coil network for inducing a high-frequency electromagnetic field into said mixture so as to induce a plasma in said gaseous mixture;

a start-up amalgam sample disposed within said plasma;

a control amalgam sample for controlling the vapor pressure of said mercury during steady-state operation of said lamp, said control amalgam having a selected warm-up time, said warm-up time being a time required for said control amalgam to reach a selected temperature approaching a steady-state operating temperature of said control amalgam after said lamp is energized; and a diffusion path extending to said control amalgam, wherein said diffusion path establishes a rate at which said control amalgam absorbs said mercury from said gaseous mixture;

wherein said warm-Up time of said control amalgam and said rate at which said control amalgam absorbs said mercury from said gaseous mixture are established such that said control amalgam reaches said selected temperature at a time approximately coincident with said control amalgam gaining control of mercury vapor pressure within said vessel.

23. The lamp of claim 22 wherein said path includes a conduit, and wherein said control amalgam is disposed within said conduit.

24. The lamp of claim 23 wherein said conduit is between 1 and 2 inches long.

25. The lamp of claim 23 wherein said conduit has a cross-sectional area of approximately 30 square millimeters.

26. The lamp of claim 22 wherein said start-up amalgam and said control amalgam comprise indium.

27. The lamp of claim 22 wherein said transfer function provides for maximum power transfer efficiency when said control amalgam is at a steady-state operating temperature.

28. The lamp of claim 22 wherein said electromagnetic field oscillates between 100 kHz and 30 MHz.

29. The lamp of claim 22, further comprising a supporting member for supporting said start-up amalgam, said member having very low thermal conductivity.

30. The lamp of claim 29 wherein said supporting member comprises a glass strand.

31. An electrodeless discharge lamp having a radio frequency power source, said lamp comprising:

a sealed lamp vessel containing a gaseous mixture of mercury and a rare gas;

a coil network for inducing a high-frequency electromagnetic field into said mixture so as to induce a plasma in said gaseous mixture;

a start-up amalgam disposed within said plasma; and a control amalgam sample substantially thermally isolated from inner surfaces of said vessel, said control amalgam sample for controlling the vapor pressure of said mercury during steady-state operation of said lamp.

32. The lamp of claim 31, further comprising:

a diffusion path extending to said control amalgam, wherein said diffusion path establishes a rate at which said control amalgam absorbs said mercury from said gaseous mixture;

wherein said control amalgam has a selected warm-up time, said warm-up time being a time required for said control amalgam to reach a selected temperature approaching a steady-state operating temperature after said lamp is energized; and wherein said warm-up time of said control amalgam and said rate at which said control amalgam absorbs said mercury from said gaseous mixture are established such that said control amalgam reaches said selected temperature at a time approximately coincident with said control amalgam gaining control of mercury vapor pressure within said vessel.

33. The lamp of claim 31, wherein said control amalgam is thermally isolated from said power source.

34. The lamp of claim 31, further comprising a supporting member for supporting said start-up amalgam and thermally isolating said start-up amalgam from inner surfaces of said vessel.

35. The lamp of claim 31, further comprising a supporting member for supporting said control amalgam and thermally isolating said control amalgam from inner surfaces of said vessel.

36. The lamp of claim 32, said start-up amalgam comprising mercury before said lamp is energized, said mercury being quickly released into said vessel when said lamp is energized, said mercury condensing on inner surfaces of said vessel until said inner surfaces gain control of the mercury vapor pressure within said vessel, wherein the mercury vapor pressure remains between 4.5 to 7.0 mTorr from the time at which said inner surfaces gain control of the mercury vapor pressure to the time at which said control amalgam gains control of the mercury vapor pressure.

* * * * *